US012232638B1

(12) United States Patent
Fay, III et al.

(10) Patent No.: US 12,232,638 B1
(45) Date of Patent: Feb. 25, 2025

(54) PLATE

(71) Applicant: Stabulum Group, LLC, Ames, IA (US)

(72) Inventors: James Edward Fay, III, Boulder, CO (US); Cameron James Lynch, Iowa City, IA (US); Andrew Schroeder Heller, Ames, IA (US); Trung Lo Deo, Urbandale, IA (US); Danilo Rovina Manfre, West Des Moines, IA (US)

(73) Assignee: Stabulum Group, LLC, Ames, IA (US)

( * ) Notice: Subject to any disclaimer, the term of this patent is extended or adjusted under 35 U.S.C. 154(b) by 566 days.

(21) Appl. No.: 17/490,801

(22) Filed: Sep. 30, 2021

Related U.S. Application Data

(60) Provisional application No. 63/085,751, filed on Sep. 30, 2020.

(51) Int. Cl.
*A47G 19/02* (2006.01)

(52) U.S. Cl.
CPC ..... *A47G 19/025* (2013.01); *A47G 2400/08* (2013.01)

(58) Field of Classification Search
CPC ..... A47G 19/08; A47G 19/10; A47G 19/02
See application file for complete search history.

(56) References Cited

U.S. PATENT DOCUMENTS

| | | | | | |
|---|---|---|---|---|---|
| 1,583,512 | A * | 5/1926 | Worth | A47G 19/03 | 220/574.3 |
| 2,157,407 | A * | 5/1939 | Frost | B65D 77/202 | 229/125.015 |
| 2,315,591 | A * | 4/1943 | Carew | A47G 19/02 | 220/574.3 |
| 3,515,262 | A * | 6/1970 | Ornstein | B65D 25/00 | 206/217 |
| 3,698,594 | A * | 10/1972 | Boehlert | A47G 19/03 | 119/61.5 |
| 4,500,573 | A * | 2/1985 | Piaggi | B44C 3/046 | 156/303.1 |
| 5,485,937 | A * | 1/1996 | Tseng | A47G 19/02 | 220/636 |
| 6,296,488 | B1 * | 10/2001 | Brenkus | A47G 19/025 | 283/117 |
| 6,561,375 | B1 * | 5/2003 | Nagy | B65D 1/34 | 206/460 |
| 7,204,202 | B2 * | 4/2007 | Behun | A01K 5/0128 | 119/61.5 |
| 7,673,753 | B1 * | 3/2010 | Huckert | A47G 19/025 | 206/541 |

(Continued)

*Primary Examiner* — Don M Anderson
(74) *Attorney, Agent, or Firm* — Nyemaster Goode P.C.

(57) ABSTRACT

A plate assembly that includes a hoop having a hoop profile shape and a hoop cross-section shape and a plate shell having a first surface the receives food to be eaten and a second surface defining a cavity on a bottom surface of the plate shell, the cavity having a plate shell profile shape and a plate shell cross-section shape. The cavity receives at least a portion of the hoop; and the hoop is removably engaged and disengaged with the cavity of the plate shell by hand and without the use of tools and provides structural integrity to the plate shell when engaged with the cavity. The plate shell is typically a disposable plastic plate shell having a thickness of about 0.008 of an inch or less.

20 Claims, 16 Drawing Sheets

(56) References Cited

U.S. PATENT DOCUMENTS

| | | | | |
|---|---|---|---|---|
| 8,646,413 | B2 * | 2/2014 | Padia | A01K 5/0135 119/61.5 |
| 8,769,849 | B1 * | 7/2014 | McCombs | A47G 19/025 220/574 |
| 8,851,013 | B2 * | 10/2014 | Tsengas | B29C 65/48 119/61.3 |
| 9,936,829 | B2 * | 4/2018 | Verdirame | G09B 5/02 |
| 10,368,665 | B2 * | 8/2019 | Cameron | A47G 19/025 |
| 10,729,261 | B2 * | 8/2020 | Ellison | A47G 19/08 |
| 11,098,888 | B1 * | 8/2021 | Walker | A47G 19/02 |
| 2001/0007325 | A1 * | 7/2001 | Kroll | A47G 19/10 229/407 |
| 2008/0203100 | A1 * | 8/2008 | Young | A01K 5/0114 220/666 |
| 2010/0018970 | A1 * | 1/2010 | Jain | A01K 7/00 220/62.11 |
| 2013/0216735 | A1 * | 8/2013 | Fleet | B43L 1/008 428/14 |
| 2014/0166667 | A1 * | 6/2014 | Cameron | G09F 23/08 220/574 |
| 2015/0289689 | A1 * | 10/2015 | Verdirame | G09B 19/0092 220/574 |
| 2021/0037997 | A1 * | 2/2021 | Hocking | A47G 19/025 |
| 2021/0068566 | A1 * | 3/2021 | Eisenberg | H01F 7/02 |
| 2022/0204222 | A1 * | 6/2022 | Yerushalmi | A47G 19/2205 |
| 2022/0218130 | A1 * | 7/2022 | Szilagyi | A47G 19/02 |
| 2023/0329464 | A1 * | 10/2023 | Malizia | A47G 19/025 |

* cited by examiner

PLATE

CROSS-REFERENCE TO RELATED APPLICATION

This application claims priority to and the benefit of U.S. Provisional Application 63/085,751, filed on Sep. 30, 2020, entitled "PLATE," the disclosure of which is hereby incorporated herein by reference in its entirety.

BACKGROUND

The present disclosure generally relates to dishware. More specifically, the present disclosure relates to a plate assembly.

Typical reusable plates must be washed between each use. In environments where plates are shared between multiple different people, this can be a sanitary concern if each plate is not properly sanitized between uses. While typical disposable plates may be used, typical disposable plates must be completely disposed of after use. Disposing of the entire disposable plate creates unnecessary waste.

Further, typical disposable plates include an integral rim to add strength to the plate. The rim is made from the same material as the plate and has limited ability to add strength to the plate.

Additionally, typical plates, both reusable and disposable, tend to slide and tip while being used. While some plates include suction cups to adhere the plate to the table, the suction cups do not allow the plate to adhere to many materials and tend to work poorly. Further, typical plates have a cantilevered perimeter edge making them easier to tip. While still a problem for adults and teens, this cantilevered edge and the tendency for plates to slide and tip are particularly problematic for children when using traditional plates with cantilevered edges.

SUMMARY

An aspect of the present disclosure is generally directed to a plate assembly that includes a hoop having a hoop profile shape and a hoop cross-section shape and a plate shell having a first surface; and a second surface defining a cavity, the cavity having a plate shell profile shape and a plate shell cross-section shape. The cavity is configured to receive at least a portion of the hoop. The hoop is configured to provide structural integrity to the plate shell.

Another aspect of the present disclosure is generally directed toward a plate assembly having a hoop that includes a hoop profile shape and a hoop cross-section shape and a plate shell that includes a first surface and a second surface defining a cavity, the cavity having a plate shell profile shape and a plate shell cross-section shape. The hoop is at least partially disposed within the cavity and coupled to the plate shell. The hoop provides structural integrity to the plate shell.

The present disclosure further includes a plate assembly having a hoop having a hoop profile shape and a hoop cross-section shape; and a plate shell having a first surface and a second surface defining a cavity, the cavity having a plate shell profile shape and a plate shell cross-section shape; a first configuration wherein the hoop and the plate shell are separate; and a second configuration wherein the hoop is at least partially disposed within the cavity and coupled to the plate shell and the hoop provides structural integrity to the plate shell.

The present disclosure further includes a plate shell having a first surface; and a second surface defining a cavity, the cavity having a plate shell profile shape and a plate shell cross-section shape. The cavity is configured to receive at least a portion of a hoop. The hoop provides structural integrity to the plate shell.

Yet another aspect of the present disclosure is generally directed to a method of assembling a plate that includes the steps of providing a hoop having a hoop profile shape and a hoop cross-section shape and a plate shell having a first surface and a second surface defining a cavity, the cavity having a plate shell profile shape and a plate shell cross-section shape and disposing the hoop at least partially within the cavity.

The present disclosure further is generally directed toward a plate assembly having a circumferential band of material having a top surface that defines an upwardly facing cross-sectional top surface profile and an exterior side facing surface; and a plate shell having a perimeter rim section having a bottom surface that is shaped to at least partially matingly engage the top surface of the circumferential band of material. The bottom surface of the perimeter rim section typically has a cross-sectional shape that at least substantially corresponds to the upwardly facing cross-sectional top surface profile across at least a majority of the perimeter rim section when the perimeter rim section engages the circumferential band of material and a food receiving section that is recessed below the perimeter section. The circumferential band of material and the plate shell engage and disengage one another by hand and without the use of tools.

Another aspect of the present disclosure is generally directed to a kit having a circumferential band of material having a top surface that defines an upwardly facing cross-sectional top surface profile and an exterior side facing surface; and a plurality of plate shells. Each plate shell includes a perimeter rim section having a bottom surface that is shaped to at least partially matingly engage the top surface of the circumferential band of material. The bottom surface of the perimeter rim section has a cross-sectional shape that at least substantially corresponds to the upwardly facing cross-sectional top surface profile across at least a majority of the perimeter rim section when the perimeter rim section engages the circumferential band of material; and a food receiving section that is recessed below the perimeter section. The circumferential band of material and the plate shell engage and disengage one another by hand and without the use of tools.

Another aspect of the present disclosure is generally directed toward a kit having a plurality of plate shells. Each plate shell typically includes a perimeter rim section having a bottom surface that is shaped to at least partially matingly engage the top surface of a circumferential band of material wherein the bottom surface of the perimeter rim section has a cross-sectional shape that at least substantially corresponds to the upwardly facing cross-sectional top surface profile across at least a majority of the perimeter rim section when the perimeter rim section engages the circumferential band of material. The plate shell further typically has a food receiving section that is recessed below the perimeter section. The circumferential band of material and the plate shell engage and disengage one another by hand and without the use of tools.

These and other aspects, objects, and features of the present invention will be understood and appreciated by those skilled in the art upon studying the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features may be exaggerated in scale or shown in schematic form in the interest of clarity and conciseness.

DETAILED DESCRIPTION

It is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all sub-ranges beginning with a minimum value of 1 or more and ending with a maximum value of 10 or less (e.g., 1 to 6.1, or 2.3 to 9.4), and to each integer (1, 2, 3, 4, 5, 6, 7, 8, 9, 10) contained within the range. In this specification and the appended claims, the singular forms "a," "an" and "the" include plural reference unless the context clearly dictates otherwise. All combinations of method steps or process steps as used herein can be performed in any order, unless otherwise specified or clearly implied to the contrary by the context in which the referenced combination is made.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the Applicant intends to indicate "only A or B but not both" then the term "only A or B but not both" will be employed. Thus, use of the term "or" herein is the inclusive, and not the exclusive use. Also, to the extent that the terms "in" or "into" are used in the specification or the claims, it is intended to additionally mean "on" or "onto."

Referring generally to the FIGURES, a plate assembly having a hoop and a plate shell is provided. In some embodiments, the plate shell is fully disposable. The plate shell couples to the hoop, and the hoop stabilizes the plate shell. In other embodiments, the plate shell is reusable.

Figure 1:
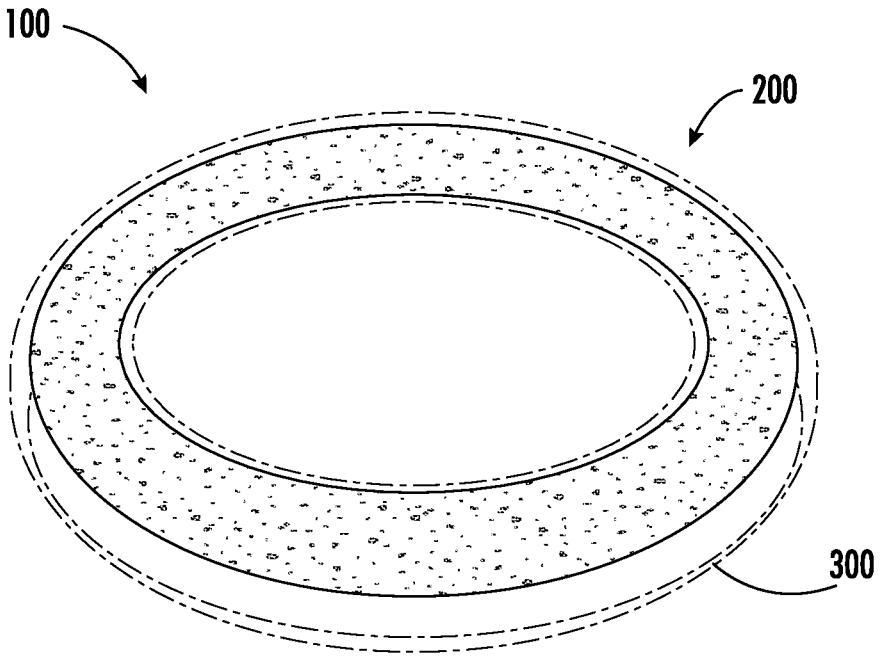
FIG. 1 is a front perspective view of a plate assembly.
Figure 2:
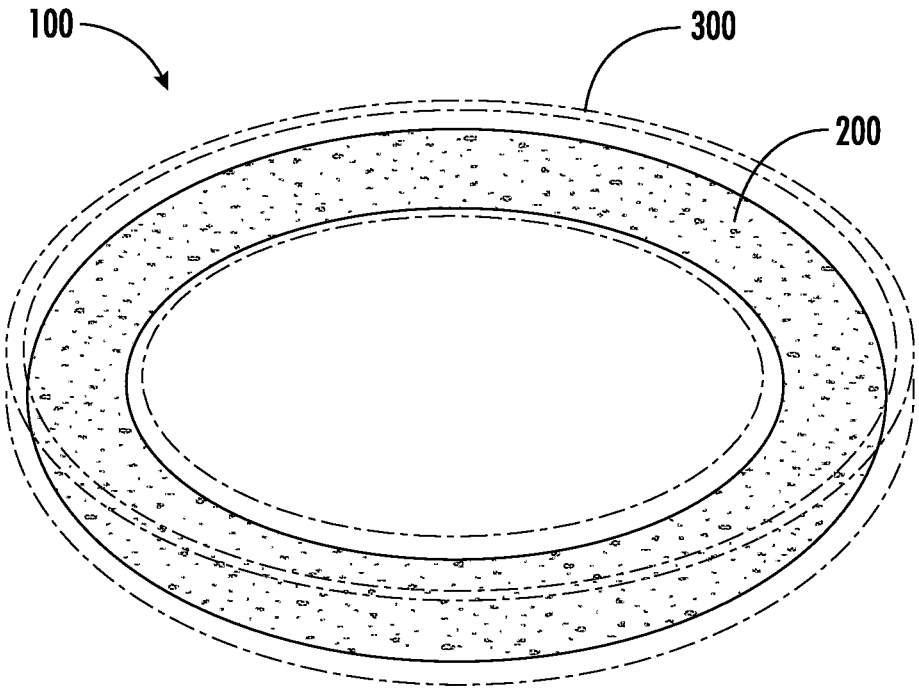
FIG. 2 is a rear perspective view of the plate assembly of FIG. 1 with the disposable or removable plate portion shown transparently to shown the spatial relationship between the hoop and the plate shell, but the plate shell may be transparent, translucent or opaque.

Referring to FIGS. 1 and 2, an embodiment of the plate assembly 100 is illustrated. A plate assembly 100 includes a circumferential band of material, which is typically in the form of a hoop 200 and a plate shell 300. The hoop 200, as will be discussed in more detail below, can be of any shape and does not need to be in the shape of a ring as shown, but can also be a rectangular shaped material with a rectangular cross-section or any other shaped as desired. The hoop 200 is removably coupled to the plate shell 300, typically by an adhesive or another fashion such that it is removably coupled and decoupled by hand and without the use of tools. The hoop 200 may be a foam material, such as injection molded flexible thermoplastic foam. The hoop may be formed of a silicon material such as silicone rubber or an elastomer composed of silicone. The hoop 200 may also be formed of a core material, which may be a flexible deformable thermoplastic foam, a polyurethane foam, or hard plastic material, for example, a high-density polyethylene material, with a silicon coating such as a silicone rubber or elastomer composed of silicone applied thereto. The hoop may have the portion that is comprised of or coated with silicone that touches the support surface, typically the table the plate is placed on, and the remaining portion of the composite hoop other material not containing or coated with silicone to facilitate the insertion of the hoop into engagement with the plate shell. The silicone portion is adhesive due to its high coefficient of friction and thereby facilitates the plate assemblies of the present disclosure not moving while in use. The silicone portion that contacts the support surface, typically the table, can have various shapes to increase the contact area. For example, the silicon containing portion may be flat or concave. When concave the portion may create a suction force and spread further out when engaged with the support surface and a downward force applied thereto. This configuration may, of course, be used when the entire hoop comprises a silicone material as well.

The plate shell 300 typically is constructed of a thin material with a thickness that is typically about 0.008 of an inch or less, more typically about 0.006 of an inch or less. The thin material is a material that has a thickness which requires additional support to allow the material to maintain a structural shape. The plate shell 300 is easily bendable by hand and without the use of tools. When the hoop 200 is coupled to the plate shell 300, the hoop 200 stabilizes the plate shell 300 providing support to at least a portion of the plate shell 300. Further, the hoop 200 provides support to at least a portion of the plate shell 300 such that when an object (e.g. food) is loaded onto the plate shell 300, the hoop 200 will support the plate shell 300 such that the plate shell 300 maintains the structural shape. At least a portion of the plate shell 300 cannot maintain a structural shape under force when the hoop 200 is not coupled to the plate shell 300. The plate shell may be transparent allowing the user to see the hoop 200, translucent or opaque where the hoop is not visible through the plate shell when the hoop is engaged on the underside of the plate shell. The plate shell assembly 100 is described in further detail below.

Figure 3:
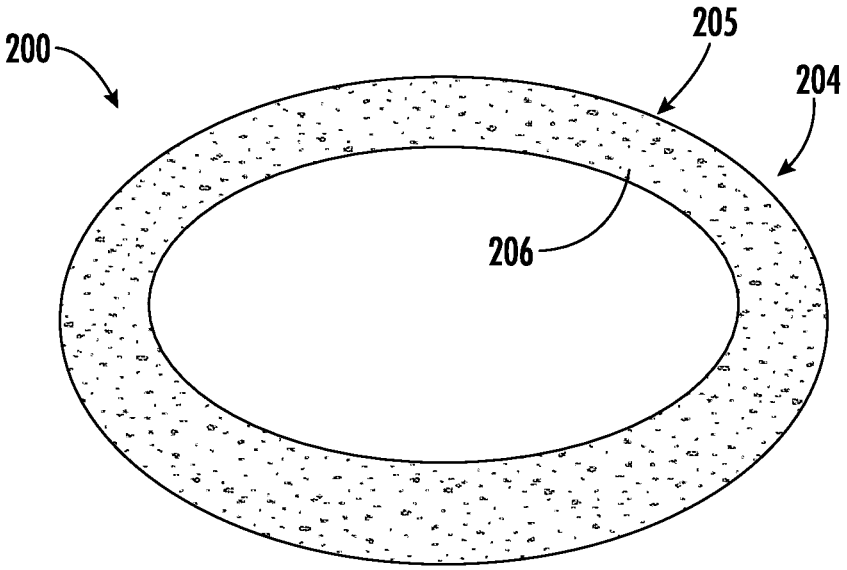
FIG. 3 is a front perspective view of a hoop aspect of the present disclosure.
Figure 4:
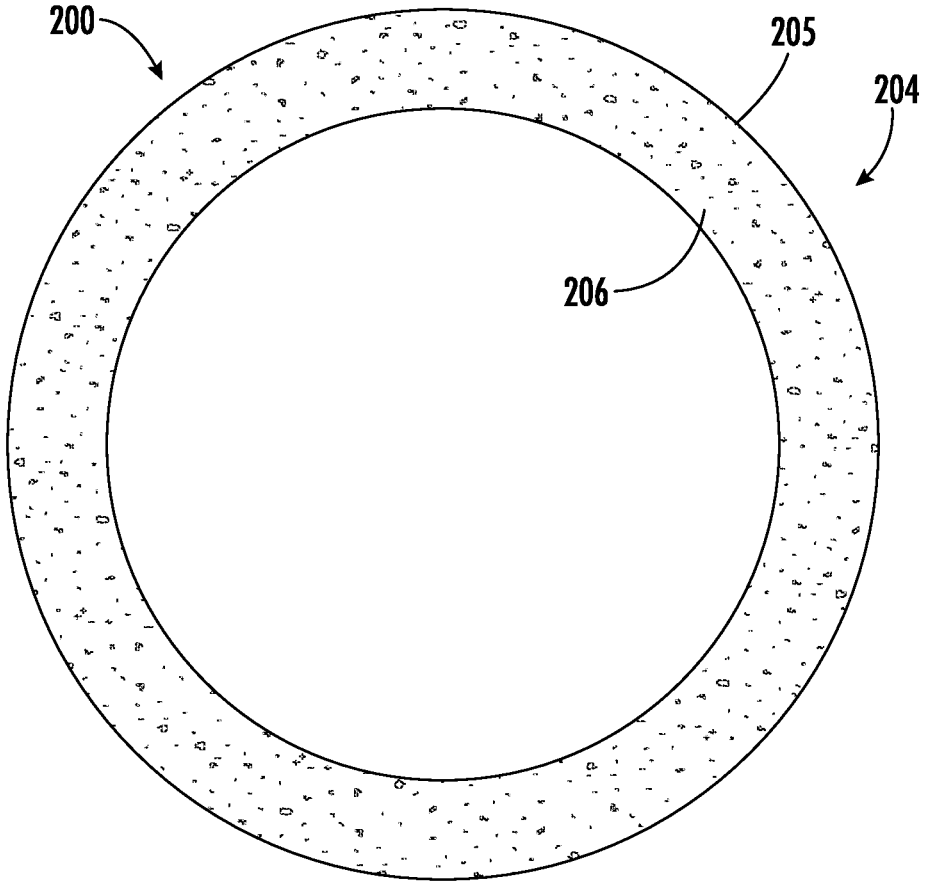
FIG. 4 is a top view of the hoop of FIG. 3.
Figure 5:
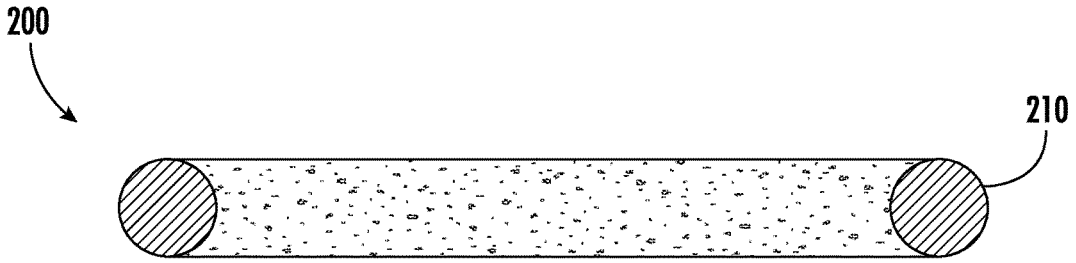
FIG. 5 is a front cross-sectional view of the hoop of FIG. 3.

Referring to FIGS. 3-5, an embodiment of the hoop 200 is illustrated. As discussed above, the hoop 200 can be of any shape when viewed from a top view and have essentially any cross-sectional shape as well, including one or more hollowed portions in the cross-sectional shape; however, the hoop typically has a solid cross-section through the entire hoop. The hoop 200 includes a profile shape 204 having an outer shape 205 and an inner shape 206. As shown in FIGS. 3 and 4, the profile shape 204 includes a circle as the outer shape 205 and a circle as the inner shape 206. In some embodiments, the outer shape 205 and the inner shape 206 are the same shape. In other embodiments, the outer shape 205 and the inner shape 206 are different shapes. The inner shape 206 is sized such that the inner shape 206 fits within the bounds of the outer shape 205. The outer shape 205 and the inner shape 206 may each be any geometric shape, including any combination of different or similar shapes for the outer shape 205 and the inner shape 206. While described as a "hoop" 200, the shape is not limited to a round circle, but is configured to be a shape that engages at least the outer perimeter of the plate shell 300. The "hoop" may be of any shape such as a fish as shown in one aspect of the plate shell shown in FIG. 19. The "hoop" is a matingly engaging perimeter support structure. While typically a hoop or ring shape, the shape is not to be limited to a ring or round shape, but is a circumferential support band. Significantly, while typically the hoop/circumferential band of material is one unitary element, the hoop could conceivably be formed from more than one portion to form a complete circumferential band/hoop from more than one portion thereof. If formed from one or more portions the portioned might be held together with hook and loop fasteners or other permanent or temporary adhesives.

The hoop 200 further includes a cross section shape 210. As illustrated in FIG. 5, the cross-section shape 210 is a circular shape. The cross-section shape 210 may be any geometric shape, but is typically either circular or rectangular.

Figure 6:
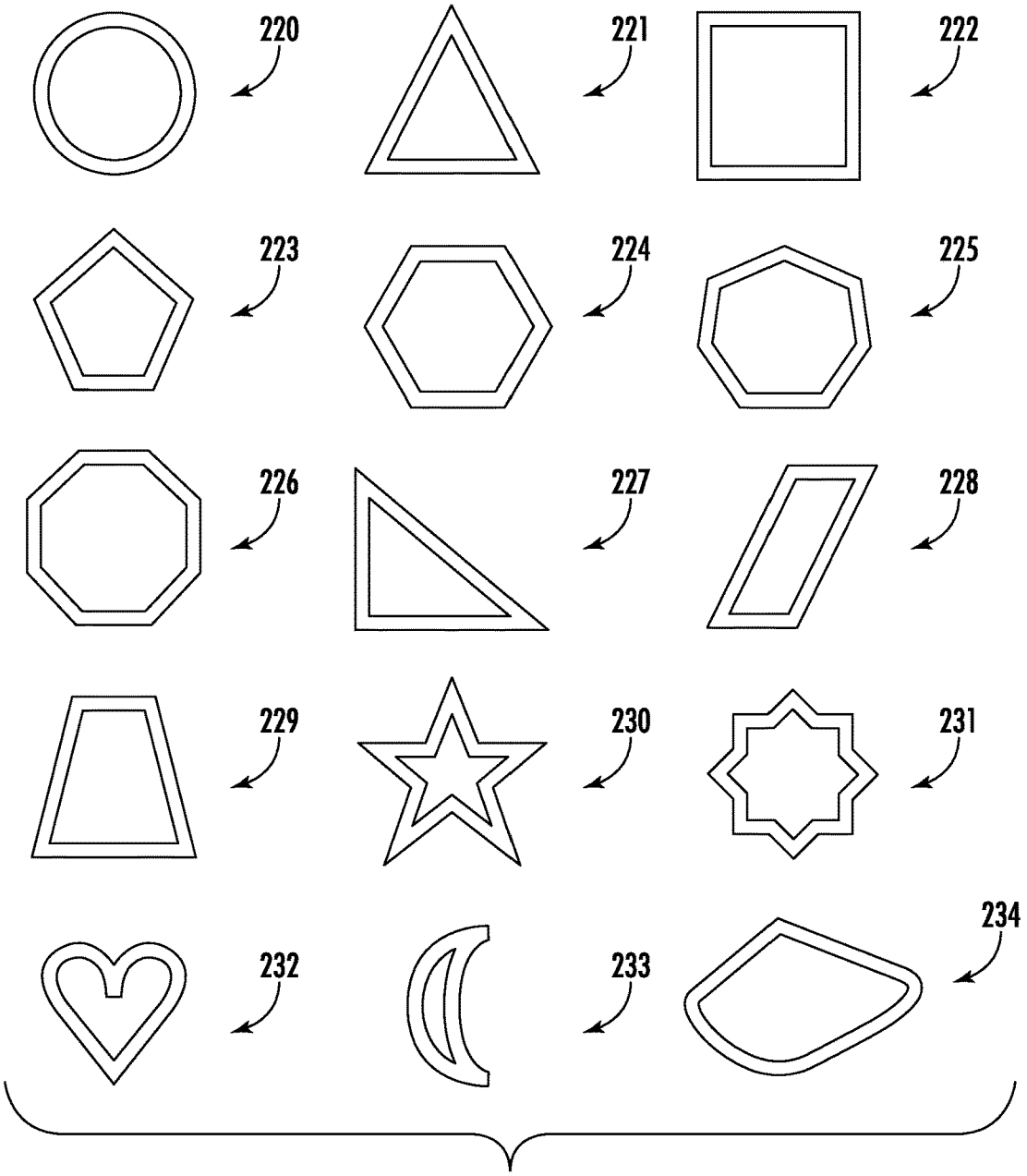
FIG. 6 is a top view of different hoop profile shape embodiments.

As illustrated in FIG. 6, a plurality of possible shapes of the profile shape 204 are shown. While FIG. 6 illustrates different shape configurations of profile shape 204, the illustrated configurations are exemplary only and the profile shape 204 may be any geometric shape. Further, each of the shapes illustrated in FIG. 6. may be either the outer shape 205 or the inner shape 206. Profile shape 220 illustrates a circular profile. Profile shape 221 illustrates a triangular profile. Profile shape 222 illustrates a square profile. Profile shape 223 illustrates a pentagon profile. Profile shape 224 illustrates a hexagon profile. Profile shape 225 illustrates a heptagon profile. Profile shape 226 illustrates an octagon profile. Profile shape 227 illustrates a right triangle profile. Profile shape 228 illustrates a parallelogram profile. Profile shape 229 illustrates a trapezoid profile. Profile shape 230 illustrates a star shape profile. Profile shape 231 illustrates an octagram star shape profile. Profile shape 232 illustrates a heart shape profile. Profile shape 233 illustrates a crescent shape profile. Profile shape 234 illustrates a geometric shape profile. Any combination of the shapes illustrated in FIG. 6 may make either of the outer profile 205 or the inner profile 206. For example, in some embodiments, the outer shape 205 is the circular profile 220, and the inner shape 206 is the hexagon profile 224. In other embodiments, the outer shape 205 is the geometric shape profile 234 and the inner shape 206 is the star profile 230. Further, in some embodiments, the inner shape 206 is centered within the outer shape 205. In other embodiments, the inner shape 206 is not centered within the outer shape 205. While FIG. 6 illustrates several possible profile shape 204 configurations, it is understood that the profile shape 204 may be any geometric shape.

Figure 7:
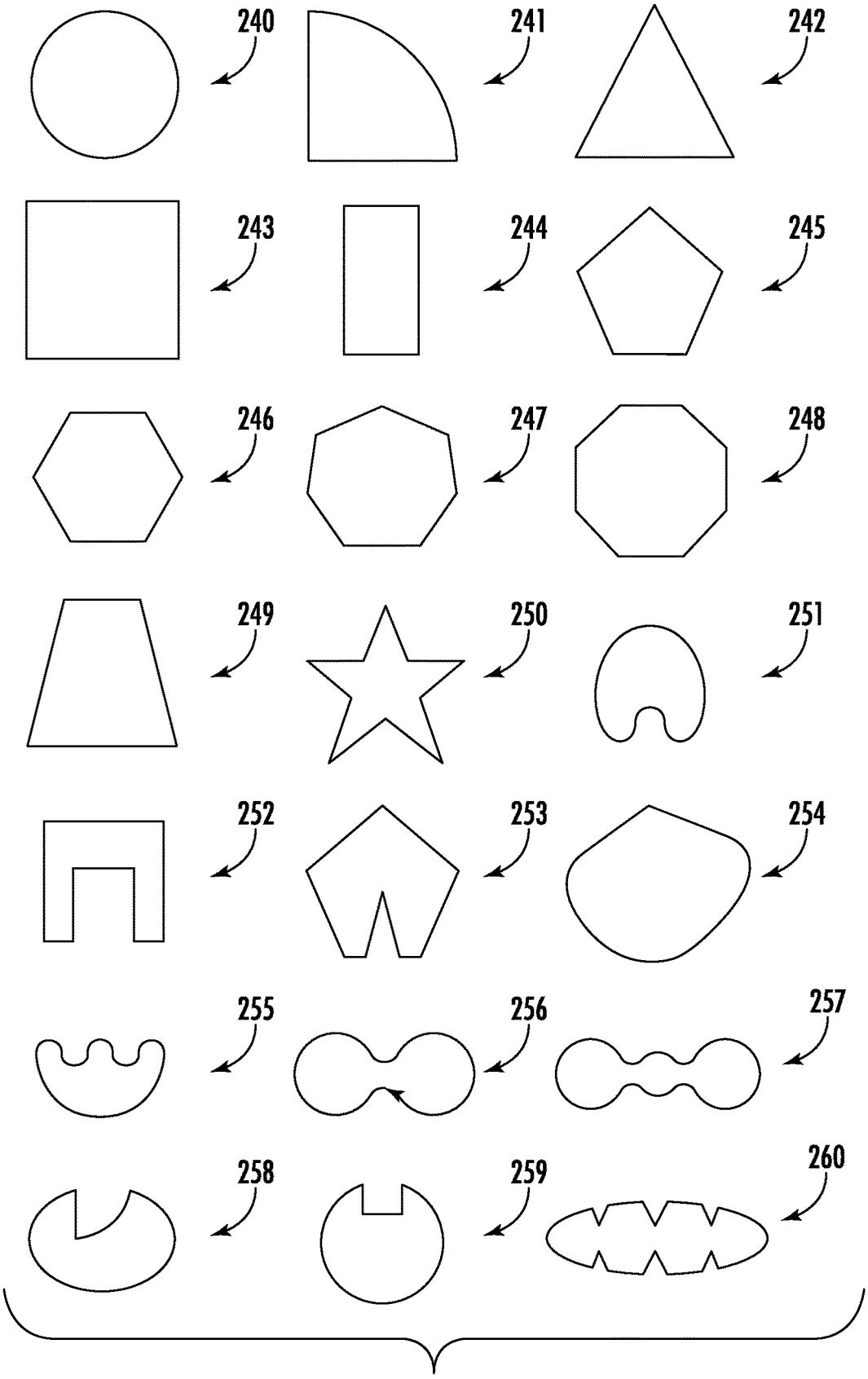
FIG. 7 is a front view of different hoop cross-section shape embodiments.

In some embodiments, the cross-section 210 of the hoop 200 is a solid. As illustrated in FIG. 7, a plurality of possible shapes of the cross-section shape 210 are shown. While FIG. 7 illustrates different shapes configurations of the cross-section shape 210, the illustrated configurations are exemplary only and the cross-section shape 210 may be any geometric shape. Cross-section shape 240 illustrates a circular cross-section. Cross-section shape 241 illustrates a quarter circle cross-section. Cross-section shape 242 illustrates a triangular cross-section. Cross-section shape 243 illustrates a square cross-section. Cross-section shape 244 illustrates a rectangular cross-section. Cross-section shape 245 illustrates a pentagon cross-section. Cross-section shape 246 illustrates a hexagon cross-section. Cross-section shape 247 illustrates a heptagon cross-section. Cross-section shape 248 illustrates an octagon cross-section. Cross-section shape 249 illustrates a trapezoid cross-section. Cross-section shape 250 illustrates a star cross-section. Cross-section shape 251 illustrates a c-shape cross-section. Cross-sections shape 252 illustrates a rectangular arch. Cross-section shape 253 illustrates a triangular concave pentagon cross-section. Cross-section shape 254 illustrates a geometric shape cross-section. Cross-section shapes 255-260 further show additional irregular shaped cross-sectional shapes.

Figure 8:
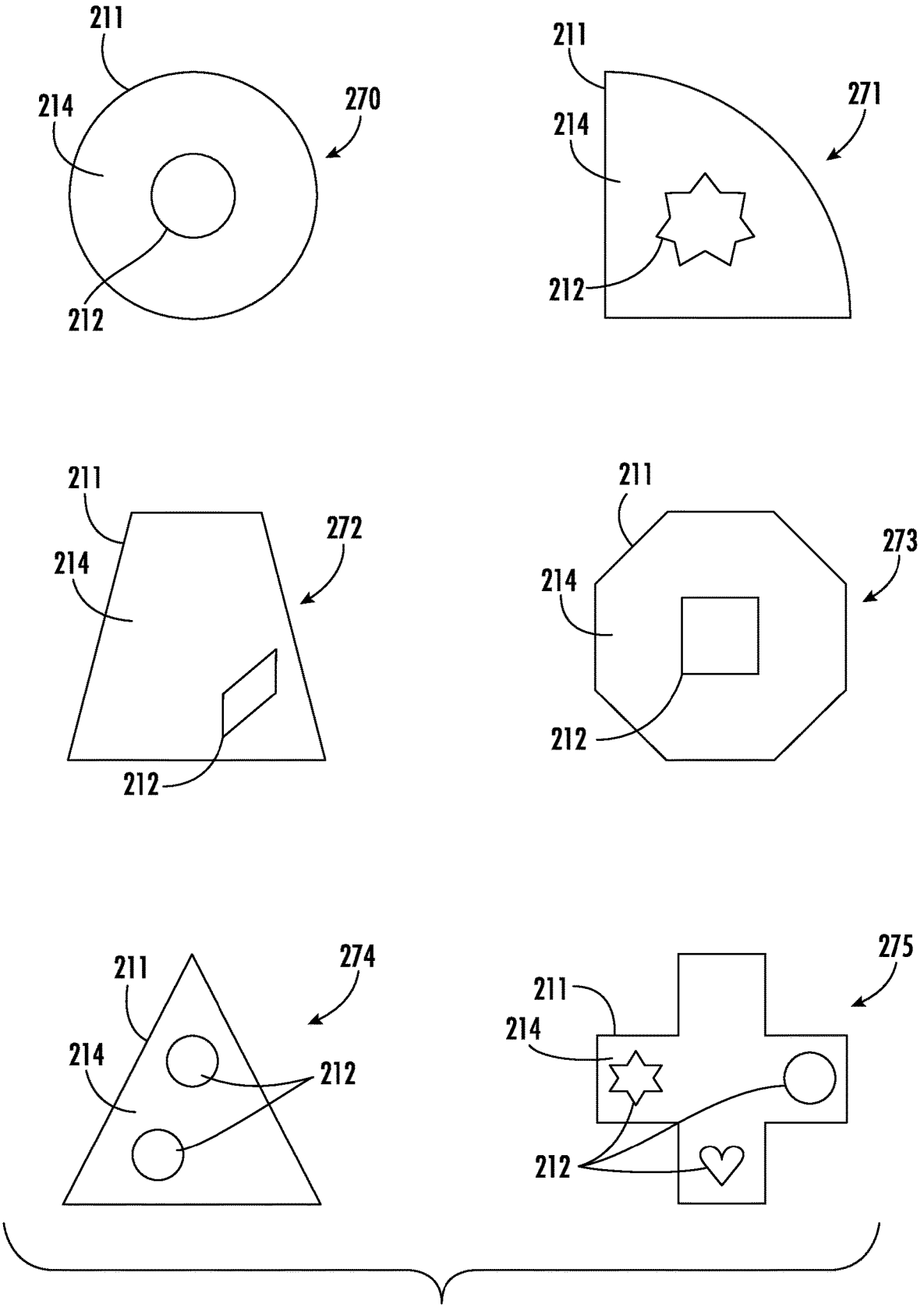
FIG. 8 is a front view of different hollow hoop cross-section shape embodiments.

In some embodiments, as discussed above, the hoop 200 may be at least partially hollow. In other embodiments, the hoop 200 may be hollow along the entire length of the hoop 200. Further, the hollow area within the hoop 200 may vary in size and shape throughout the length of the hoop 200. Referring to FIG. 8, a plurality of exemplary embodiments of the cross-section shape 210 of the hoop 200 are illustrated. Each of the cross-sections 270-275 includes an outer cross-section shape 211 and at least an inner cross-section shape 212 with a hoop wall 214 defined between the outer cross-section shape 211 and the inner cross-section shape 212. The cross-sections 270-275 illustrated are exemplary only and the cross-sections 270-275 may comprise any geometric shape. The outer cross-section shape 211 and the inner cross-section 212 may be the same shape. For example, as shown in cross-section 270, both the outer cross-section shape 211 and the inner cross-section shape 212 are circular. The outer cross-section shape 211 and the inner cross-section shape 212 may be different shapes. For example, cross-section 271 includes a quarter circle cross-section shape 211 and a seven-point star inner cross-section shape 212. The inner cross section-shape 211 may be off-center within the outer cross-section shape 212. For example, cross-section shape 272 includes a trapezoid outer cross-section shape 211 and a parallelogram inner cross-section shape 212, where the inner cross-section shape 212 is not centered with the outer cross-section shape 211. The inner cross-section shape 211 may be centered within the outer cross-section shape 212. For example, cross-section shape 273 includes an octagon cross-section shape 211 with a centered square inner cross-section shape 212. The cross-section shape 210 may include a plurality of inner cross-section shapes 212. The plurality of inner cross-section shapes 212 may all be the same inner cross-section shape 212. For example, cross section shape 274 includes a triangle outer cross-section shape 211 and two circular inner cross-section shapes 212. At least one of the pluralities of inner cross-section shapes 212 may be different inner cross-section shapes 212. For example, cross-section shape 275 includes a cross shaped outer cross-section shape 211 and three inner cross-section shapes, where each of the three inner cross-section shapes are different shapes. In some embodiments, the hoop wall 214 varies in thickness throughout the hoop 200.

As discussed above, the hoop 200 typically may be constructed of any material such as a plastic; a foam material; a silicone or silicone containing material; a silicone coated base material such as a rigid plastic, foam or wood; or a wood or other naturally rigid and resilient material. The hoop 200 is typically produced from an elastomeric foam material. The hoop material is also typically a material that is at least semi-rigid such that the hoop 200 is resistant to deformation unless acted upon by an outside force other than gravity. A semi-rigid material is a material that may deform, such as being bent or compressed when a force is applied by hand and without the use of tools; however, the semi-rigid material does not typically bend substantially in response to gravity alone. When bent or compressed when a force is applied by hand and without the use of tools, the material of the hoop will rebound and return to the same or substantially the same shape as its original shape prior to the force being applied to it. When the circumferential band of material/hoop 200 is in the shape of a ring, the semi-rigid or rigid material is such that the circumferential band of material/hoop 200 does not sag when held on one side due to the force of gravity and, as such, provides structural support and strength to the overall plate assembly when the plate shell 300 and circumferential band of material/hoop 200 are engaged with one another and the plate assembly 100 is being transported (with or without food or other comestible material on the surface of the plate shell 300) from one location such as a food dispensing location to another location such as a table or food consuming location. As already discussed, the hoop 200 may be constructed of any rigid or semi-rigid material, but is typically a foam material, for example nitrile polyvinyl chloride (NPVC), polyethylene foam, ethylene-propylene-diene-monomer foam (EPDM) polyethene foam, closed-cell foam, open-cell foam, etc. The foam material may be an extruded foam. In some embodiments, the foam is an extruded foam. The foam may be extruded such that the cross-section of the foam material is the cross-section shape 210 of the hoop 200, and the extruded foam is bent into the shape of the profile shape 204. In other embodiments, the extruded foam is extruded such that the cross-section of the foam material is the profile shape 204 of the hoop 200 and the extruded foam is cut into the shape of the cross-section shape 210. In other embodiments, the foam may be cast, machined, cut, etc. In other embodiments, the hoop 200 may be made of any material that is at least semi-rigid. For example, the hoop 200 may be constructed of a rubber, a plastic, a cardboard, a metal or metal alloys, wood, a fabric, a composite of the same or different fibers of any kind, etc.

It may be possible to extrude a portion that is a silicone containing or silicone material that forms a bottom portion of the hoop and matingly engage the silicone containing or silicone material extruded bottom portion with a top portion that is an extruded foam or other extruded material. The two separately extruded portions may then be mechanically, chemically (for example adhesively), and/or thermally engaged with one another to form the composite hoop with silicone on the bottom that facilitates frictional engagement with the support surface, typically a table or other eating surface, that the plate assembly is engaged with during use.

Referring to FIGS. 9-17, a plate shell 300 includes a first surface 301. The first surface 301 is substantially flat and surrounded by a sidewall 302. The plate shell 300 further includes a second surface 303 coupled to the sidewall 302. The second surface 303 defines a cavity 305 having a plate shell profile shape 304 and a plate shell cross-section shape 310. The plate shell profile shape 304 at least partially corresponds to the profile shape 204 of the hoop 200. The plate shell profile shape includes an outer plate shell profile shape 308 and an inner plate shell profile shape 309. In some embodiments, the outer plate shell profile shape 308 and the inner plate shell profile shape 309 may be the same shape. In other embodiments, the outer plate shell profile shape 308 and the inner plate shell profile shape 309 may be different shapes. Each of the outer plate shell profile shape 308 and the inner plate shell profile shape 309 may be any of the shapes described as the profile shape 204. Further, the plate shell profile shape may be any geometric shape. The plate shell cross-section shape 310 at least partially corresponds to the hoop cross-section shape 210 of the hoop 200. The plate shell cross-section shape 310 may be any of the shapes described as the cross-section shape 210. Further, the plate shell cross-section shape 310 may be any geometric shape. The cavity 305 is configured to receive the hoop 200. The hoop may be constructed of a material that inherently increases the coefficient of friction and resists movement on the eating surface when the plate assembly 100 is placed on the eating surface.

As discussed above, the plate shell 300 typically includes a thin material that allows the plate shell to deform significantly. Without additional support from the hoop 200, the plate shell 300 does not maintain the structural shape of the plate shell 300 when a force is applied to the plate shell 300.

Figure 9:
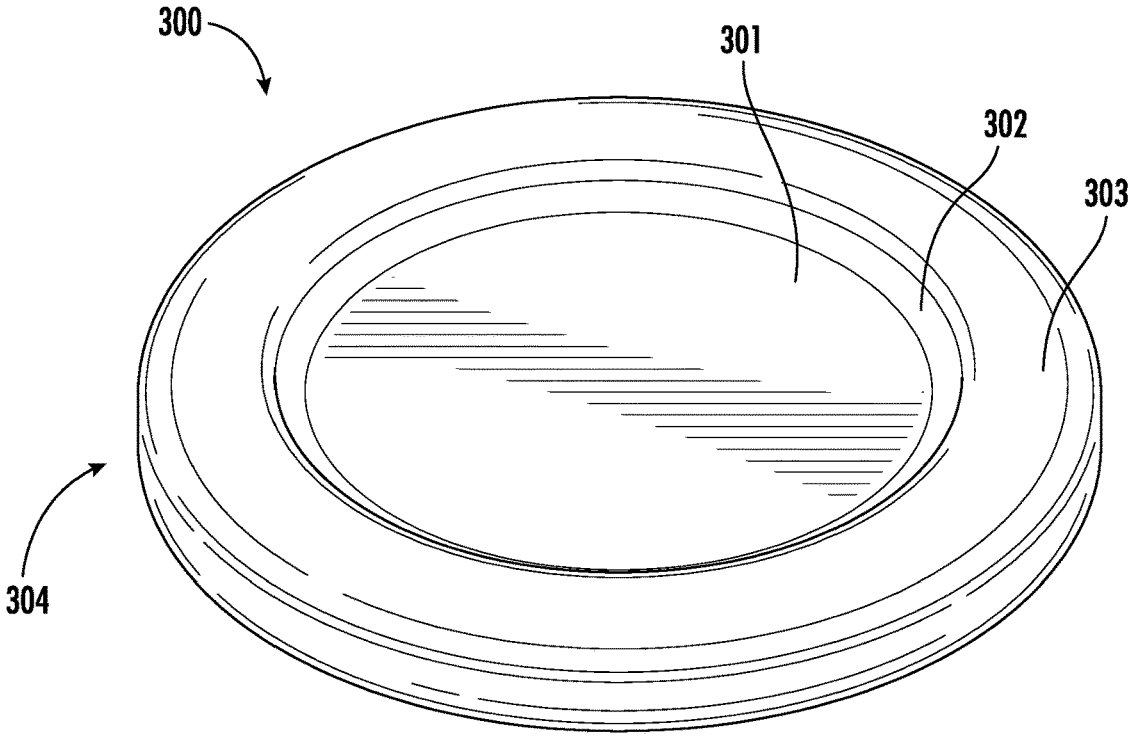
FIG. 9 is a top perspective view of a plate shell according to an aspect of the present disclosure.
Figure 10:
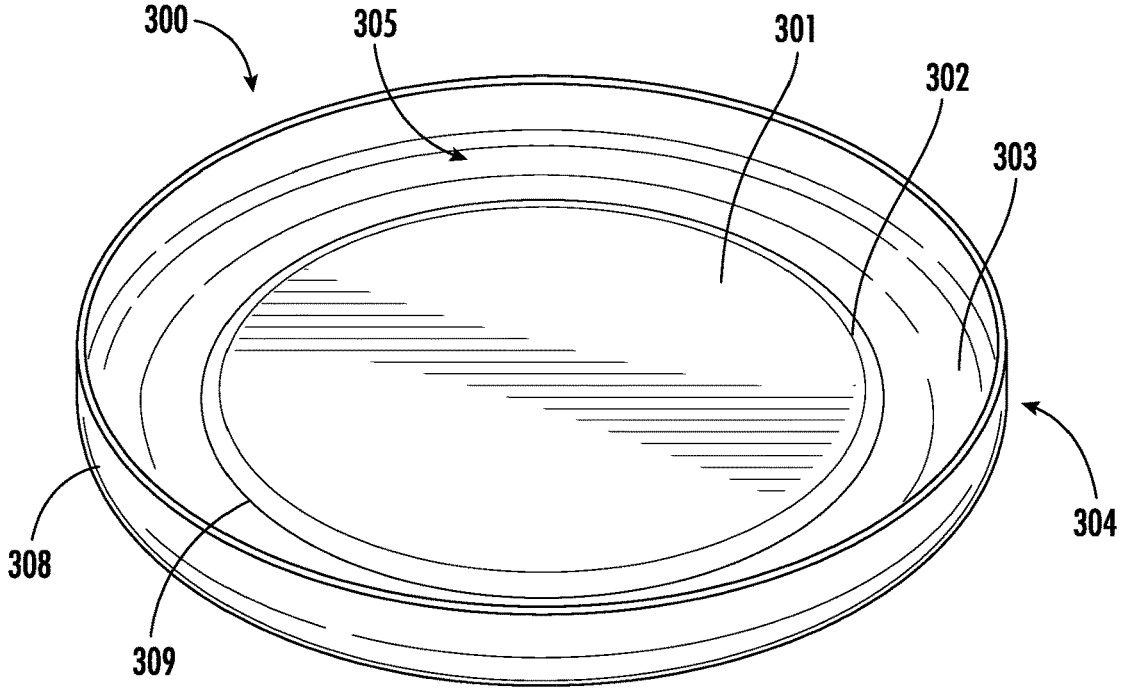
FIG. 10 is a bottom perspective view of the plate shell of FIG. 9.
Figure 11:
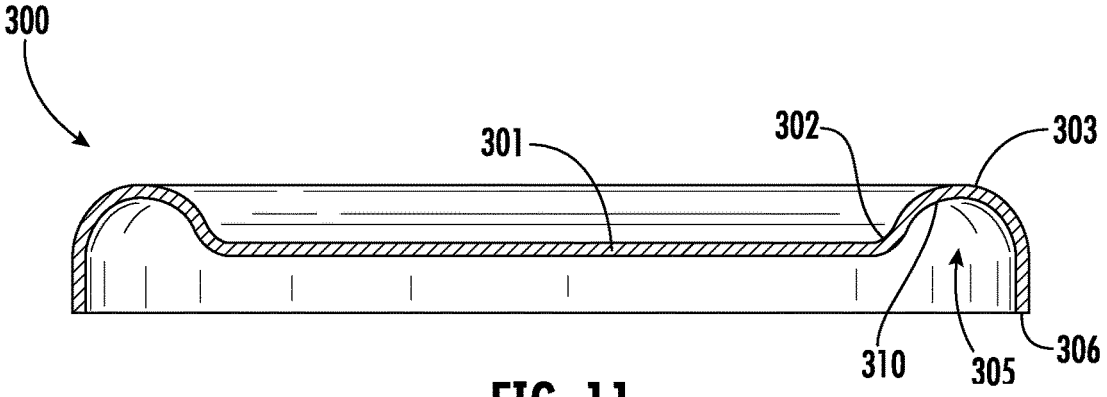
FIG. 11 is a cross-sectional view of the plate shell of FIG. 9.

Referring to FIGS. 9-11, an embodiment of the plate shell 300 is illustrated. To assemble the hoop 200 and the plate shell 300 into the plate assembly 100, the hoop 200 is lined up with the cavity 305 of the plate shell 300, and the plate shell 300 is placed over the hoop 200. The hoop 200 may then be removed from the plate shell 300 by pulling the hoop 200 from the cavity 305. As shown in the case of a ring-shaped hoop construction, the cavity 305 may be defined by a circular plate shell profile shape 304 and a plate shell cross-section shape 310 that is at least a partial circle. In the embodiment shown, the cavity 305 is configured and shaped to receive and typically hold, unless removed by the user (typically by hand and without the use of tools), the hoop 200 including a circular profile shape 204 and a circular cross-section shape 210. In this case, the top of the circular cross-section shape 210 is an exemplary upwardly facing cross-sectional top surface profile. One of ordinary skill will appreciate that a circular plate shell's perimeter rim section's cross-sectional shape may, does not have to, exactly correspond to the upwardly facing cross-sectional top surface profile, but rather will typically at least substantially correspond over at least a majority of the upwardly facing cross-sectional top surface profile. While the hoop 200 will typically matingly engage the plate shell, the engagement does not have to have a corresponding shape as discussed above. The corresponding shape profiles prevent the perimeter rim section of the plate shell from deformation during use, but the hoop of the present disclosure will achieve its primary function so long as it is retained within the cavity 305. There may be interstitial space between the top surface of the hoop 200 and the perimeter rim section of the plate shell. The hoop might only be retained within the cavity and provide sufficient supportive force to the plate shell to form a functional plate assembly for transporting food from one location to another without deformation and still be within the context of the present disclosure. The hoop and the perimeter rim section do not necessarily need to correspond exactly to one another or correspond over the entire length of one another.

In FIGS. 9-11, the first surface 301 is positioned above an edge 306 of the second surface 303; however, it is conceivable that the first surface 301 may be in approximately or exactly the same plane defined by opposing sides of the edge 306 or positioned level with the edge 306 of the second surface 303.

Figure 12:
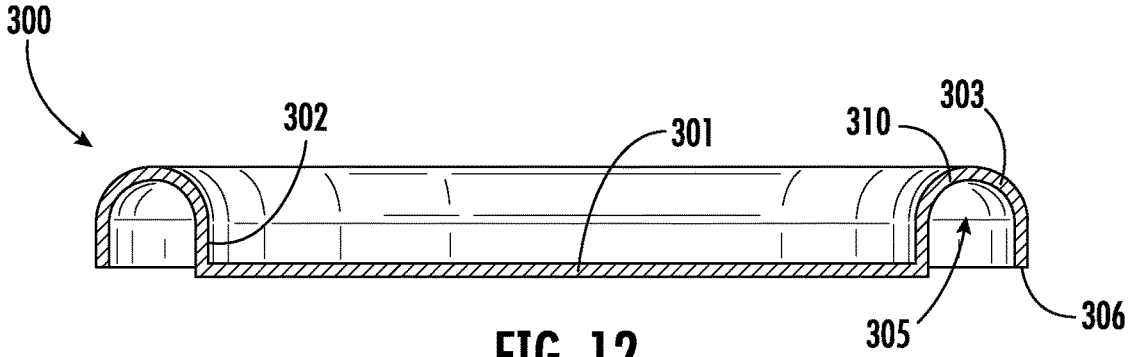
FIG. 12 is a cross-sectional view of a plate shell according to an aspect of the present disclosure.

Referring to FIG. 12, an embodiment of the plate shell 300 is illustrated. The first surface 301 is positioned below the edge 306 of the second surface 303.

Figure 13:
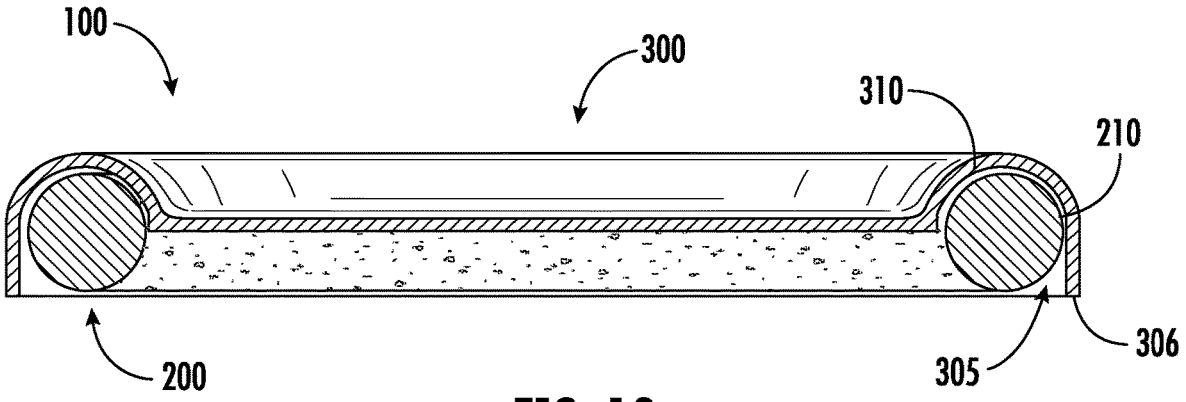
FIG. 13 is cross-sectional view of a plate assembly according to an aspect of the present disclosure.
Figure 14:
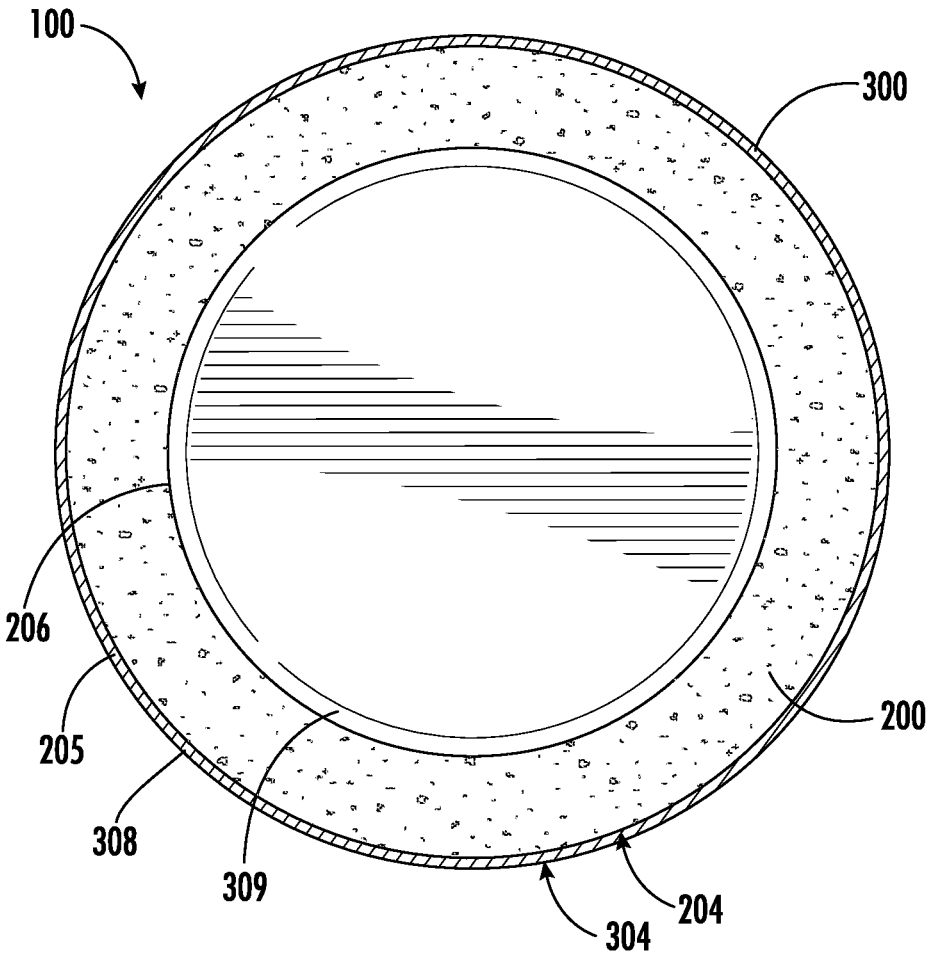
FIG. 14 is a bottom view of the plate assembly of FIG. 13.

Referring to FIGS. 13 and 14, an embodiment of a plate assembly is shown. FIG. 13 illustrates a cross-sectional view of an embodiment of the hoop and the plate shell. As shown, the cavity 305 of the plate shell 300 receives the hoop 200. The cross-section shape 210 corresponds to the plate shell cross-section shape 310. The cross-section shape 210 is smaller than the plate shell cross-section shape 310 (e.g. the radius of the circular cross-section shape 210 is less than the radius of the circular plate shell cross-section 310). The hoop 200 is coupled to the plate shell 300 by friction between the hoop 200 and the plate shell 300. In some embodiments, the cross-section shape 210 is the same size as the plate shell cross-section shape 310. In other embodiments, the cross-section shape 210 is larger than the plate shell cross-section shape 310 (e.g. the diameter of the circular cross-section shape 210 is greater than the circular plate shell cross-section shape 310). When the cross-section shape 210 is larger than the plate shell cross-section shape 310, the plate shell 300 deforms around the hoop 200 but is still received within cavity 305. In some embodiments, the plate shell 300 is coupled to the hoop 200 by a fastener (e.g. an adhesive, a clip, a tie, etc.).

Referring to FIG. 14, a bottom view of the plate assembly 100 is illustrated. As shown, the profile shape 204 matches the plate shell profile shape 304. The diameter of the inner plate shell profile shape 309 is less than the inner profile shape 206 and the outer plate shell profile shape 308 is greater than the outer profile shape 205. In some embodiments, the inner plate shell profile shape 309 is smaller than the inner profile shape 206. In some embodiments, the outer plate shell profile shape 308 is smaller than the outer profile shape 205. The plate shell profile shape 304 may expand around the profile shape 204 of the hoop 200.

The plate shell 300 is relatively flexible and not suitable to support an object (e.g. foodstuff) alone. When the hoop 200 is spaced within cavity 305 or otherwise engaged, which can be frictional coupling, to the plate shell 300, the plate shell gains significant rigidity and can support an object (e.g. foodstuff) without deformation that would otherwise occur if the hoop 200 was not spaced within cavity 305. When spaced within cavity 305, the hoop 200 provides tension to the first surface 301 of the plate shell 300. The tension provided by the hoop 200 against the plate shell 300 prevents the plate shell 300 from deforming.

Referring to FIGS. 15-19, different embodiments of the plate shell 300 are illustrated. Each of the embodiments shown in FIGS. 15-19 include a plurality of plate sections separated by at least one divider. The plate sections allow for different items (e.g. different types of food) to be separated within the plate shell 300 unless purposefully moved by the user into another section. The dividers may be integrally formed into the plate shell 300. In other embodiments, the dividers are coupled to the plate shell 300.

Figure 15:
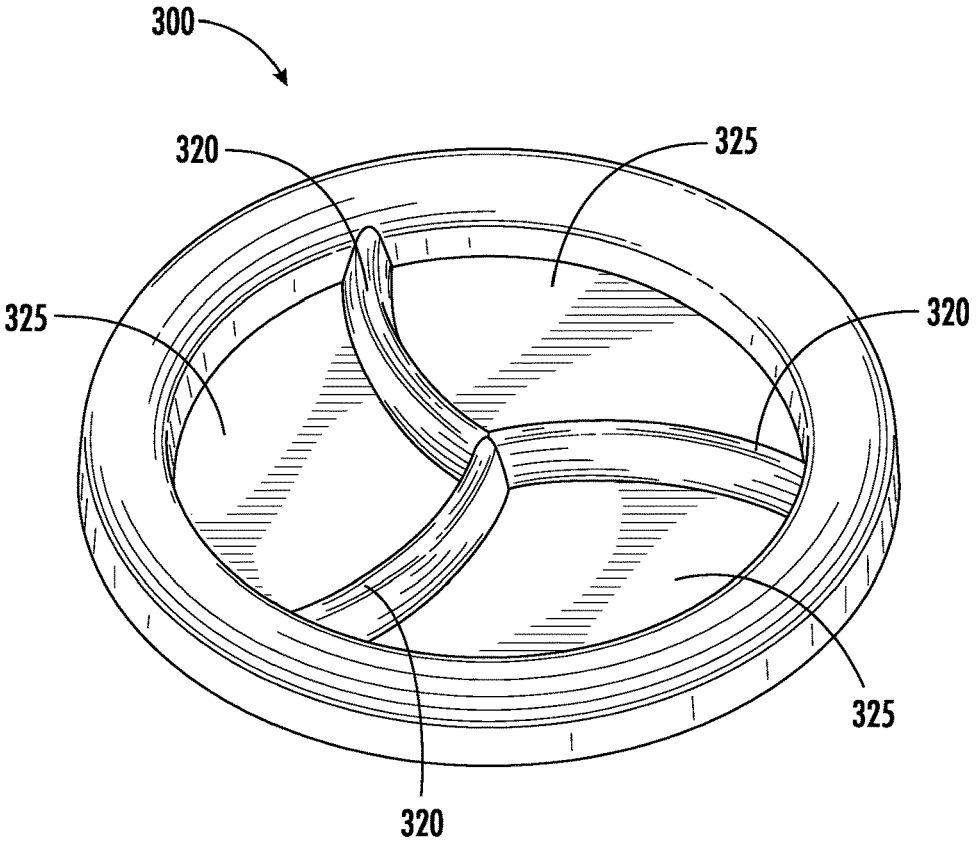
FIG. 15 is a top perspective view of a plate shell according to an aspect of the present disclosure having three food receiving sections separated by walls extending upwardly from the plate base.
Figure 16:
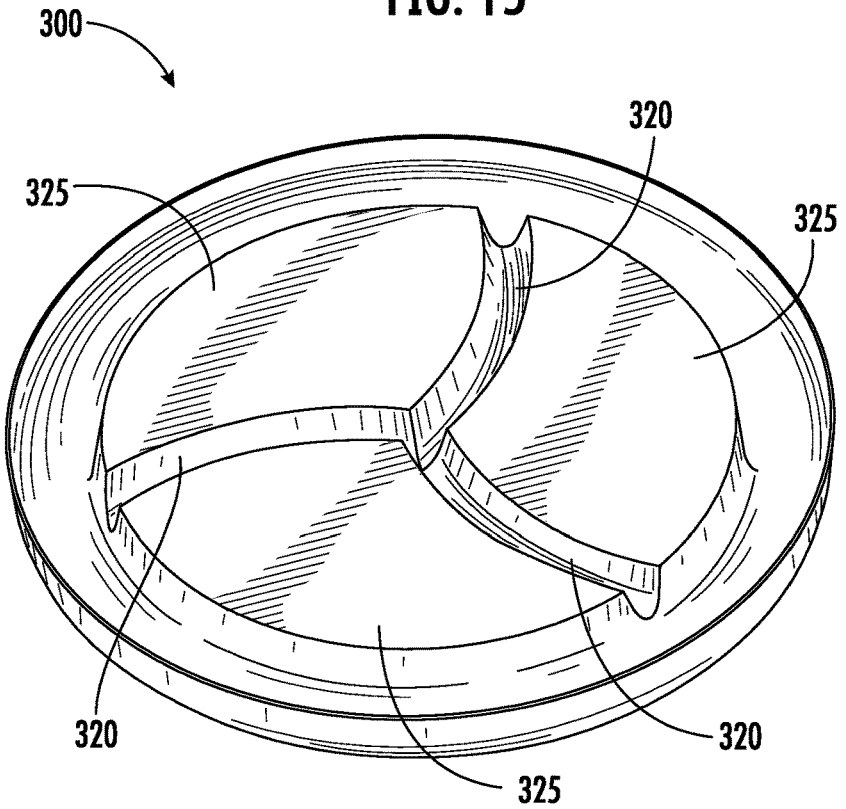
FIG. 16 is a bottom perspective view of the plate shell of FIG. 15.

Referring to FIGS. 15 and 16, an embodiment of the plate shell 300 includes a plurality of dividers 320. The dividers 320 separate the plate into a plurality of sections 325. As shown, the plurality of dividers 320 includes three curved dividers having a raised surface compared to the first surface 301. The plurality of dividers 320 separates the first surface 301 into three equal sections 325. In some embodiments, the sections 325 are not equal in either surface area or volume. In some embodiments, the dividers 320 may also add structural support to the plate shell 300.

Figure 17:
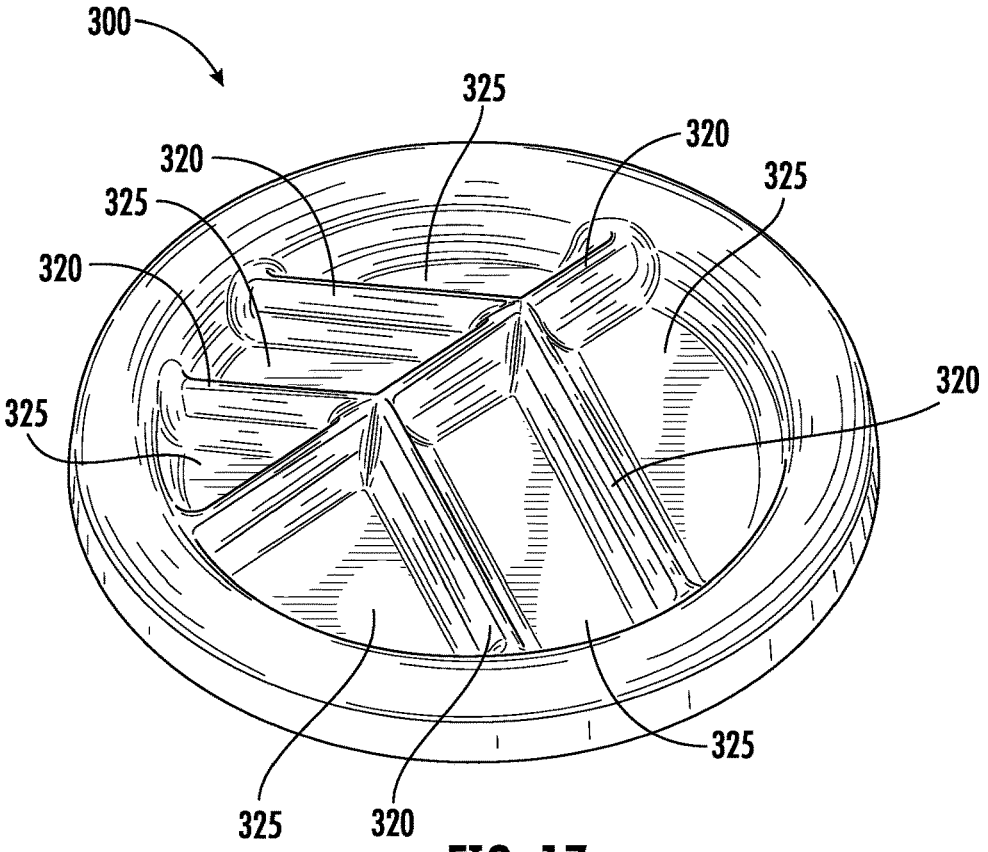
FIG. 17 is a front perspective view of a plate shell according to an aspect of the present disclosure having six food receiving sections separated by walls extending upwardly from the plate base.
Figure 18:
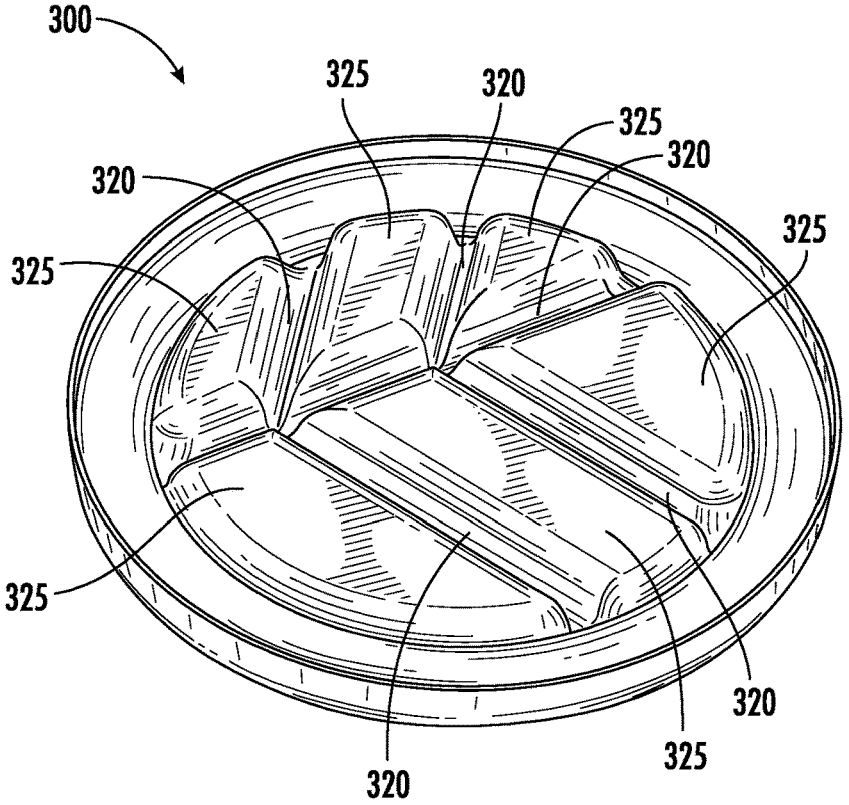
FIG. 18 is a back, perspective view of the plate shell of FIG. 17.

Referring to FIGS. 17 and 18, another embodiment of the plate shell 300 includes a plurality of dividers 320. As shown, the plurality of dividers 320 separate the first surface 301 of the plate shell 300 into six distinct sections 325. Each of the six sections 325 are shaped such that an eating utensil may easily be used within the sections 325. In some embodiments, the plurality of dividers aids the eating utensil to pick up food on the plate shell 300. Each of the six sections 325 includes different geometry. In some embodiments, each of the six sections 325 includes the same geometry. In further embodiments, some of the plurality of dividers 320 may include the same geometry and other of the plurality of dividers 320 include different geometry.

In some embodiments, at least one of the plurality of sections 325 are shaped by the plurality of dividers 320 to have one of a length or a width that corresponds to the width of an eating utensil. When the eating utensil is moved through the at least one of the plurality of sections 325, the eating utensil will fill the one of the length or the width such that the dividers 320 surrounding the at least one section 325 will guide objects (e.g. food) onto the eating utensil.

Figure 19:
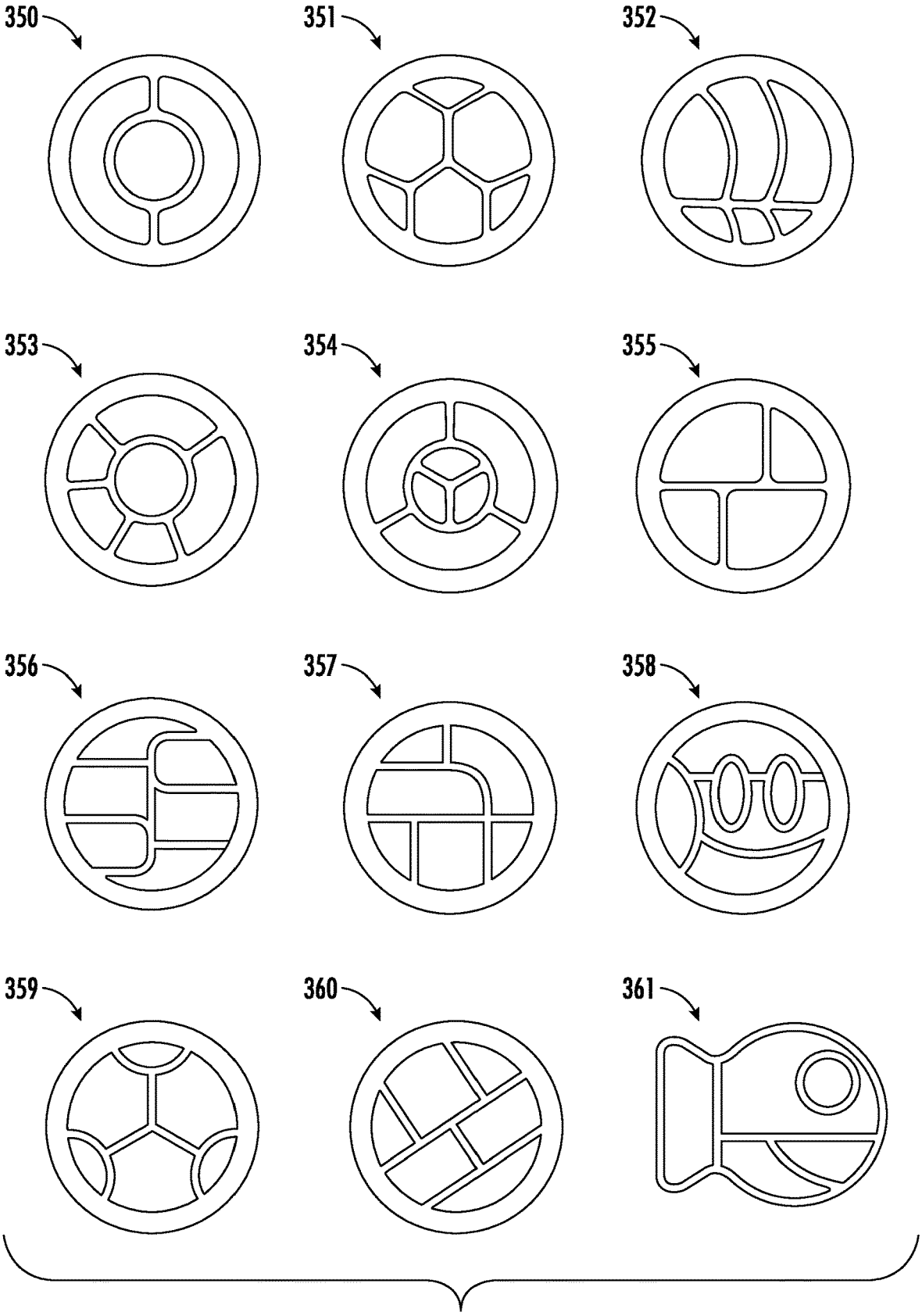
FIG. 19 is a top view of different plate shell divider embodiments and overall shapes that may be employed with corresponding hoop shapes supporting at least the perimeter thereof.

Each of the configurations includes a different style of dividers and sections. The plate shell 300 may include any number of dividers, forming any number of sections. Further, the dividers may have any geometry forming sections of any geometry. Referring to FIG. 19, plates shell 300 configurations with a different divider and sections styles are illustrated. While FIG. 19 illustrates different divider and sections configurations, the illustrated configurations are exemplary only and the divider and sections may be configured in any geometry. In each of configurations 350-361, a plate shell 300 having a circular plate shell profile shape 304 is illustrated. Each of the configurations show examples of possible divider configurations, with the lines inside the plate shell profile shape 304 representing the dividers. The plate shell profile shape 304 may be any geometric shape and include similar divider styles as illustrated in configurations 350-361.

Figure 20:
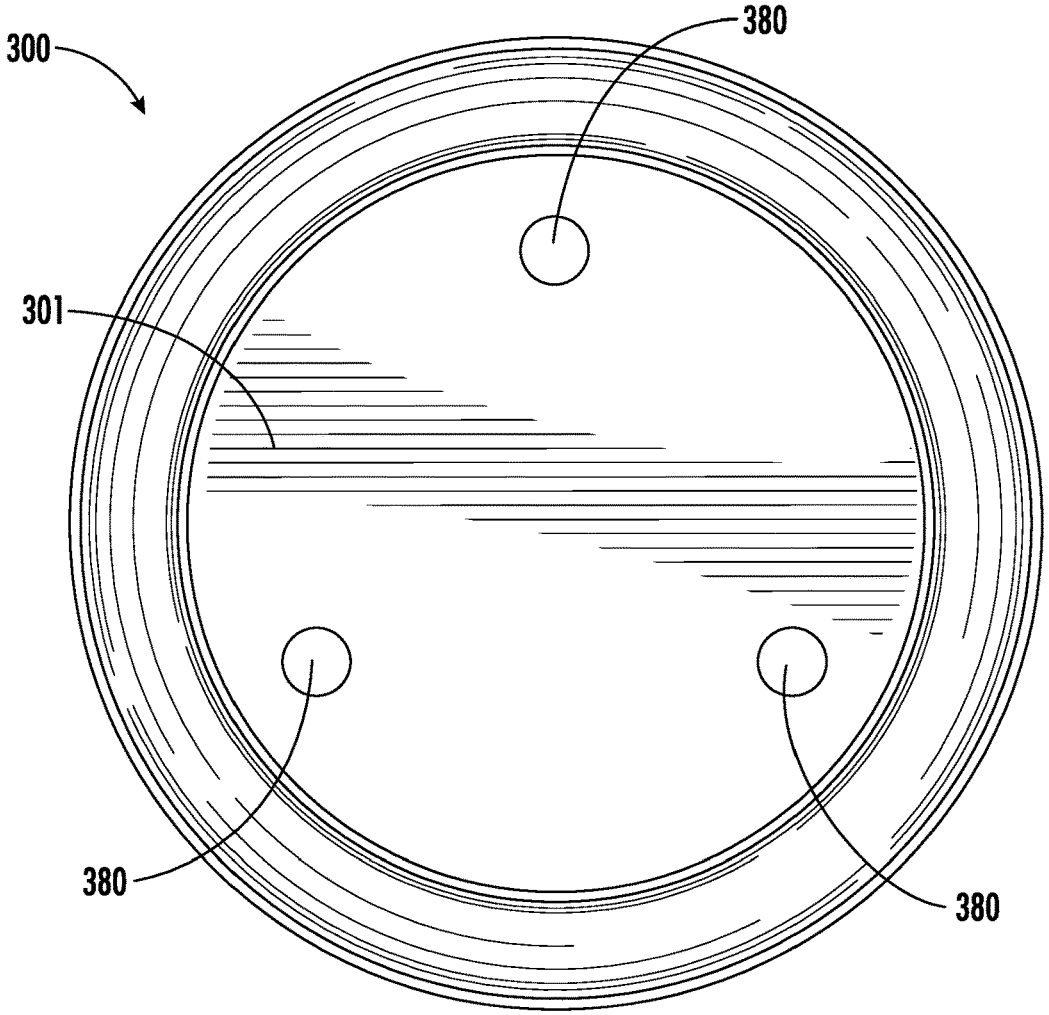
FIG. 20 is a bottom view of an embodiment of a plate shell including adhesives.
Figure 21:
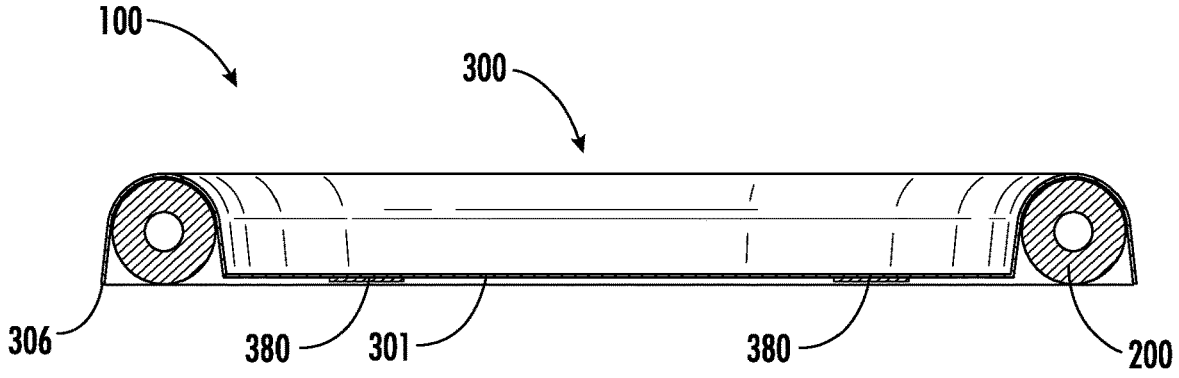
FIG. 21 is a cross-sectional view of the plate shell of FIG. 20.

According to some embodiments, the plate assembly 100 may also include adhesives to fix the plate assembly 100 to a supporting surface (e.g. a table, a tray, etc.). Referring to FIGS. 20 and 21, an embodiment of the plate shell 300 is illustrated. The plate shell 300 includes at least one adhesive disk 380 disposed on the bottom of the first surface 301. As shown in FIG. 20, the plate shell 300 includes three of the adhesive disks 380. In other embodiments, the plate shell 300 includes more or less than three of the adhesive disks 380. As shown in FIG. 21, the first surface 301 of the plate shell 300 is positioned above the edge 306 of the second surface 303. The thickness of the adhesive disk 380 is such that the bottom of the adhesive disk 380 does not extend past the edge 306 of the second surface 303. The distance between the bottom of the adhesive disk 380 and the edge 306 allows the plate shell 300 to rest on a supporting surface, without the bottom of the adhesive disk contacting the supporting surface. If a force is applied to the first surface 301 of the plate shell, for example food being placed onto the first surface 301, the plate shell 300 deforms slightly and the bottom of the adhesive disk 380 contacts the supporting surface with sufficient force to engage the adhesive to the supporting surface. This allows the plate shell 300 to be moveable relative to the support surface until a force is applied to the first surface 301 causing the adhesive disk 380 to contact the supporting surface. Once the adhesive disk 380 contacts the supporting surface, the plate shell 300 becomes fixed to the supporting surface. When assembled into the plate assembly, the plate shell 300 can be fixed to a supporting surface by the adhesive, and the hoop 200 is fixed within the cavity 305 of the plate shell 300. In other embodiments, the adhesive disk 380 has a thickness such that the bottom of the adhesive disk 380 extends past the edge 306 of the second surface 303 and adheres upon placement of the plate shell 300 onto the supporting surface.

In other embodiments, the adhesive disk 380 may be configured in a different shape or may be a single band or multiple bands of adhesive that are applied. The adhesive disk 380 may be any geometric shape. In some embodiments, the adhesive disk 380 is a ring surrounding the perimeter of the inner plate shell profile shape 309. Plate shell embodiments having dividers may also have adhesive disks 380 disposed on the first surface 301. In some embodiments, the plate shell 300 includes an adhesive disk 380 on the bottom of each of the sections created by the dividers. In other embodiments, only some of the sections created by the dividers include an adhesive disk 380.

In further embodiments, the adhesive disk 380 is disposed on the hoop 200. The hoop 200 may be placed in contact with a supporting surface thereby fixing the hoop 200 to the supporting surface. The plate shell 300 may then be coupled to the hoop 200. The plate assembly 100 will remain fixed by the adhesive disk 380 securing the hoop 200 to the supporting surface and the plate shell 300 coupled to the hoop 200 by friction between the plate shell 300 and the hoop 200.

The plate shell 300 may further include an adhesive backing 381 disposed onto the bottom of the adhesive disk 380. The adhesive backing 381 is typically a paper material that is removeable by hand and without the use of tools and operates to prevent the adhesive disk from contacting a surface until the adhesive backing is removed. In some embodiments, each of the adhesive disks 380 have a separate adhesive backing 381. In other embodiments, one adhesive backing 380 covers a plurality of adhesive disks 380. Conceivably the adhesive disks could be one portion of a hook and loop fastening system that would engage a corresponding portion of the hook and loop fastening system on a table or other surface where the plate is to be placed.

Figure 22:
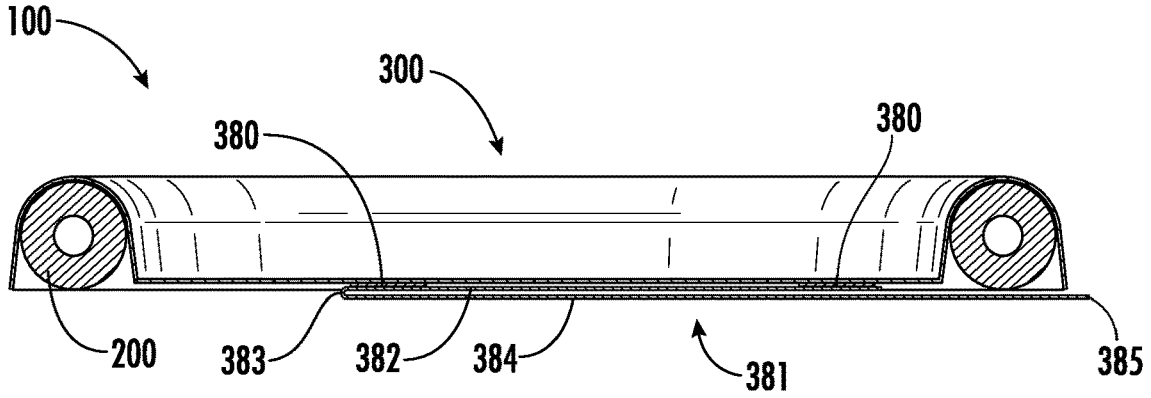
FIG. 22 is a cross-sectional view of a plate assembly including an adhesive backing.

Referring to FIG. 22, one adhesive backing 381 covers a plurality of adhesive disks 380. The adhesive backing 381 includes a top layer 382 covering each of the adhesive disks 380, and a bend 383 folding the adhesive backing 381 into a bottom layer 384. The bottom layer 384 extends back the length of the first layer 382 and past the outer plate shell profile shape 309. When the plate assembly 100 is placed onto a supporting surface and positioned, the adhesive backing 380 can be pulled at the end 385. As the end 385 is pulled, the second layer 384 will pull the bend 383 causing the first layer 382 to shear off of the adhesive 380 and expose the adhesive 380. As the adhesive backing 381 is pulled from the plate shell 300, the adhesive disks 380 will contact the supporting surface, fixing the plate assembly 100 to the supporting surface. The adhesive backing 381 can be removed from the plate shell 300 while the plate shell 300 is resting on the supporting surface using one hand.

Further, the adhesive disk 380 may be coupled to the hoop 200. The adhesive disk 380 may be used to fix the hoop 200 to the supporting surface. In some embodiments, the hoop 200 includes a cross-section profile 210 including having a cavity configured to hold an adhesive material, such as the adhesive disk 380. In further embodiments, hoop 200 includes a cross-section shape 210 configured to maximize the surface area of the bottom of the hoop 200. The large surface area of the bottom of the hoop 200 allows the hoop 200 to become fixed to the supporting surface due to the friction between the hoop 200 and the supporting surface.

Figure 23:
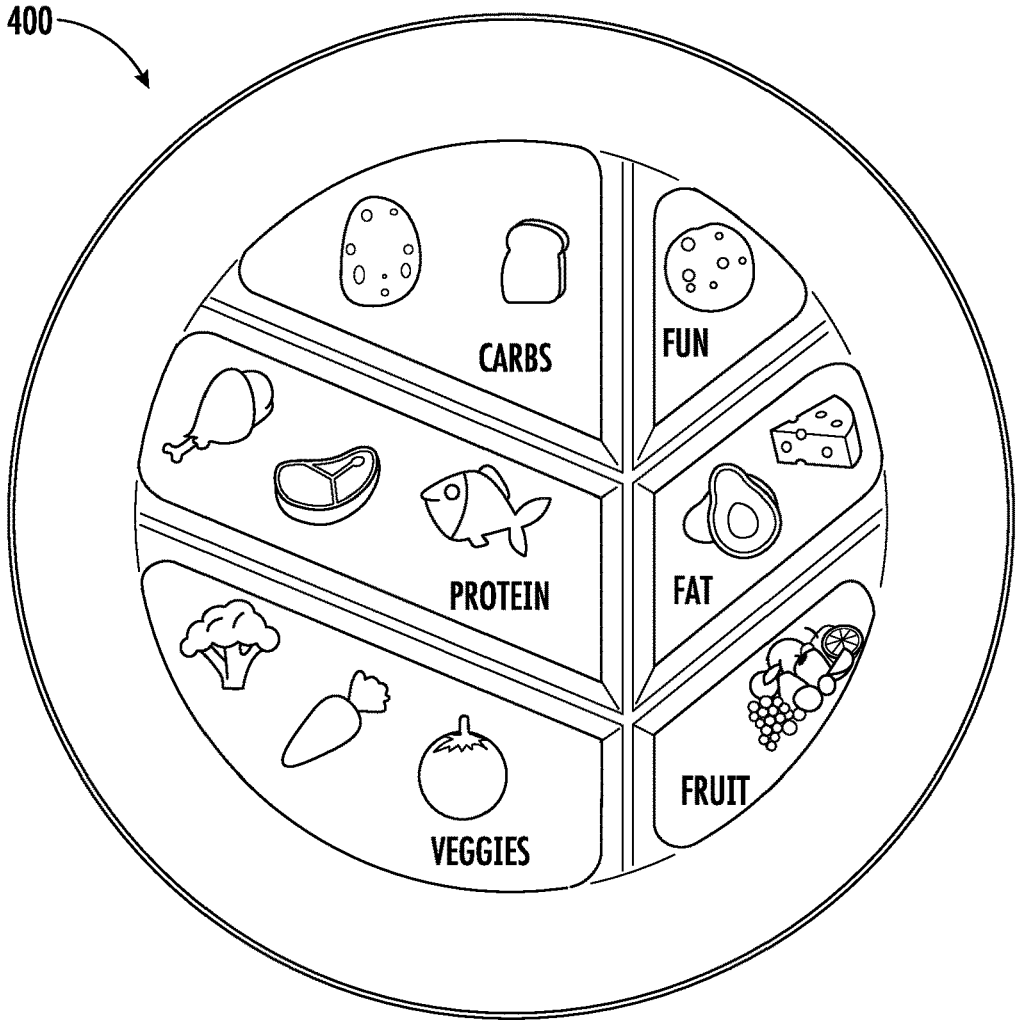
FIG. 23 is a top view of an embodiment of an information disk.
Figure 24:
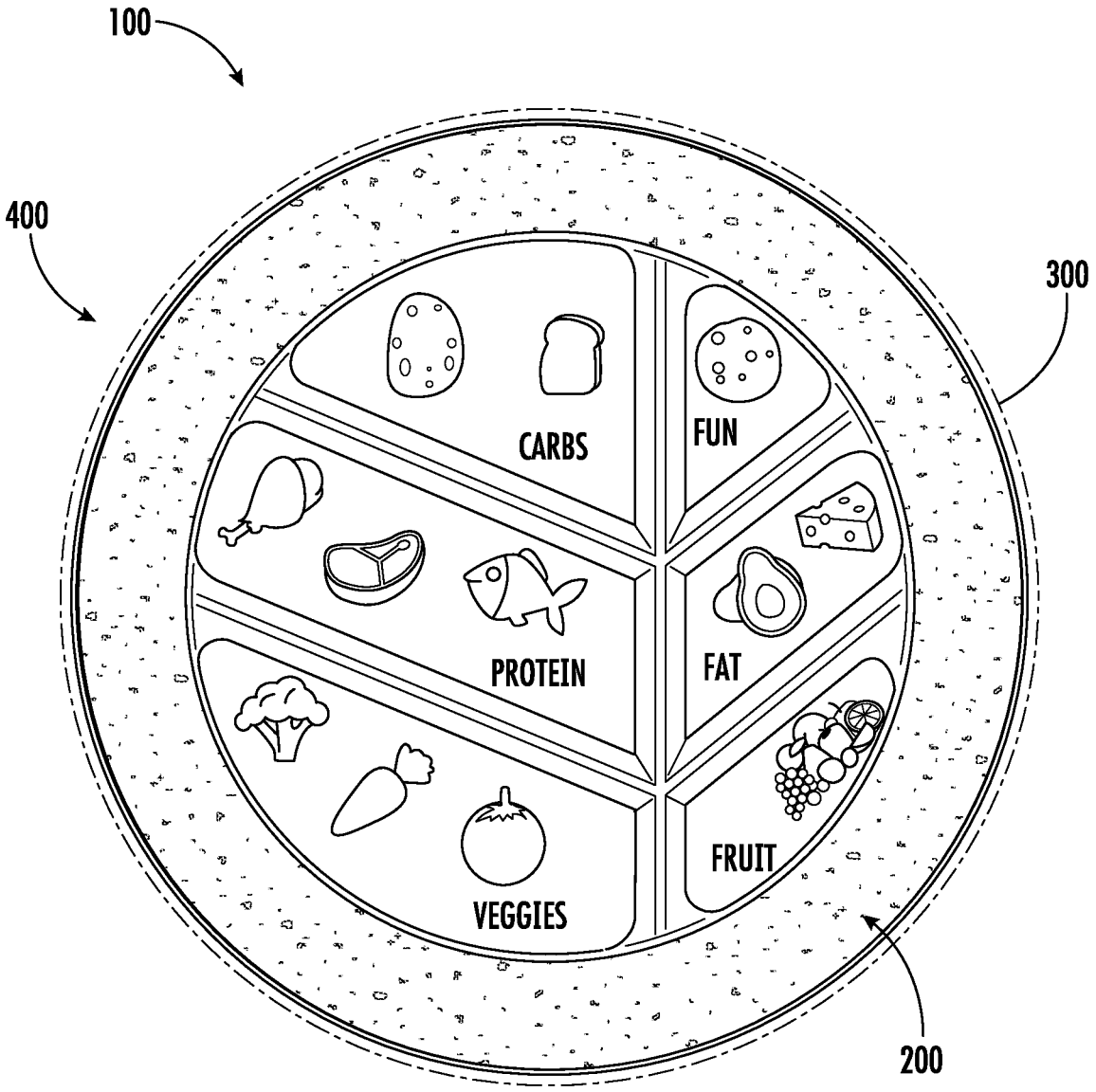
FIG. 24 is a top view of the information disk of FIG. 23 with a plate assembly.

Referring to FIGS. 23 and 24, an information disk 400 may be used with the plate assembly 100. The information disk 400 includes at least one section including information related to a meal. The information disk 400 corresponds to a plate shell 300. For example, as shown in FIGS. 23 and 24, the information disk 400 corresponds to the plate shell of FIGS. 17 and 18. As shown, the information disk 400 includes six sections, each of the six sections corresponding to a section of the plate shell 300. Each section of the information disk 400 includes at least one piece of information related to a meal. For example, each section of the informational disk 400 may correspond to a food group and include labels representative of foods within that food group. When the information disk 400 can be aligned underneath the plate shell 300, and each of the information sections show a specific food group for the corresponding section of the plate shell 300. In other embodiments, the information disk 400 can be used as a guide next to the plate shell 300, without being placed underneath the plate shell 300. The corresponding section of the plate shell 300 has a volume that corresponds with the appropriate serving size of the corresponding food group on the information disk 400. The information disk 400 may be for a specific meal and for a specific age group. For example, an information disk 400 for dinner and for a two-year-old may include a section for carbohydrates (carbs) and include a graphic of pasta. The corresponding section of the plate shell 300 for the carbs section has a volume of ⅓ of a cup to correspond with the daily recommended intake of a two-year-old at dinner by the American Academy of Pediatrics. The information disk 400 may include a plurality of configurations including breakfast, lunch, dinner, snacks, etc. Further, each of the configurations may be customized for a specific age. The volume of each of the corresponding sections of the plate shell may also be customized to correspond with the volume of food for the specific age for each meal.

Figure 25:
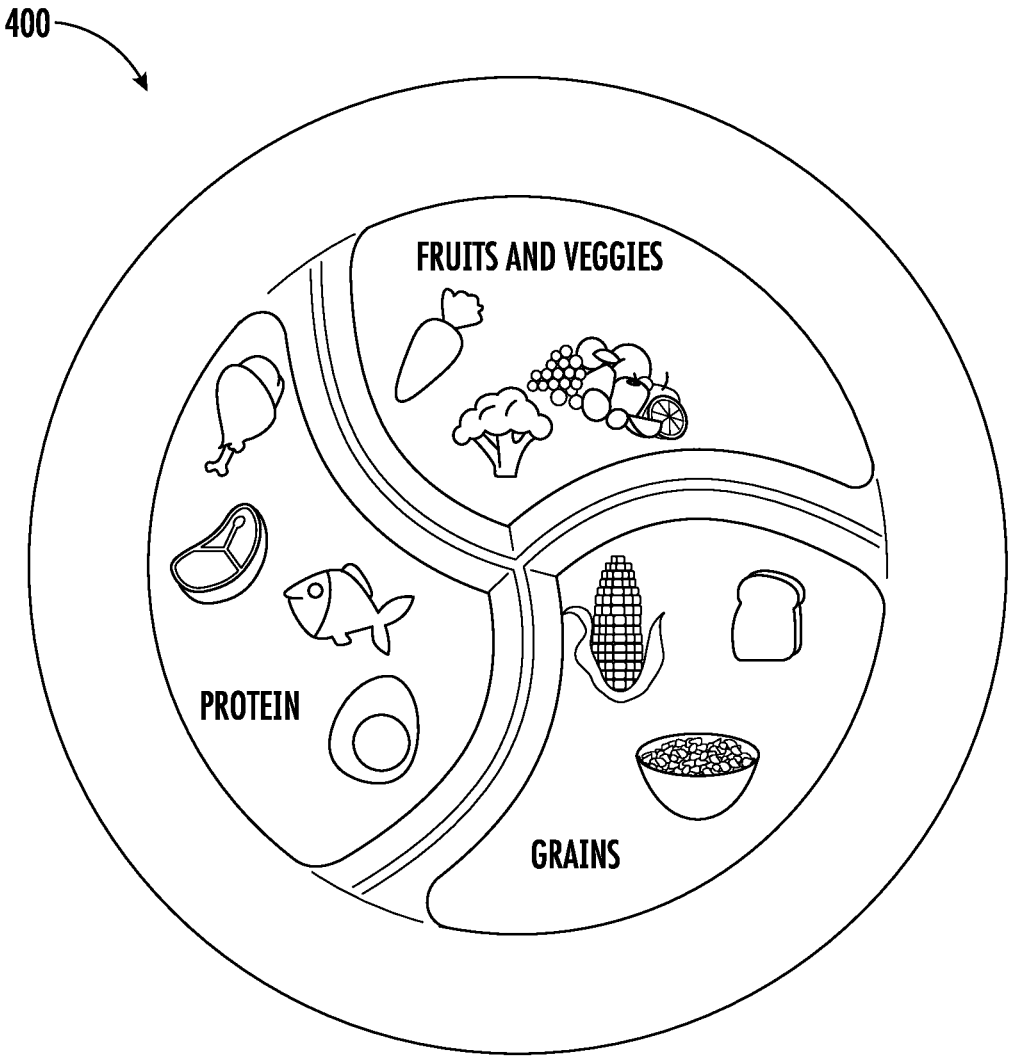
FIG. 25 is a top view of an embodiment of an exemplary information disk.

Referring to FIG. 25, an embodiment of the information disk 400 is illustrated. The information disk 400 includes three sections. In this embodiment each of the three sections corresponding to a section of the plate shell 300. Each section of the information disk 400 includes at least one piece of information related to a meal. For example, each section of the informational disk 400 may correspond to at least one food group and include labels representative of foods within that food group.

Figure 26:
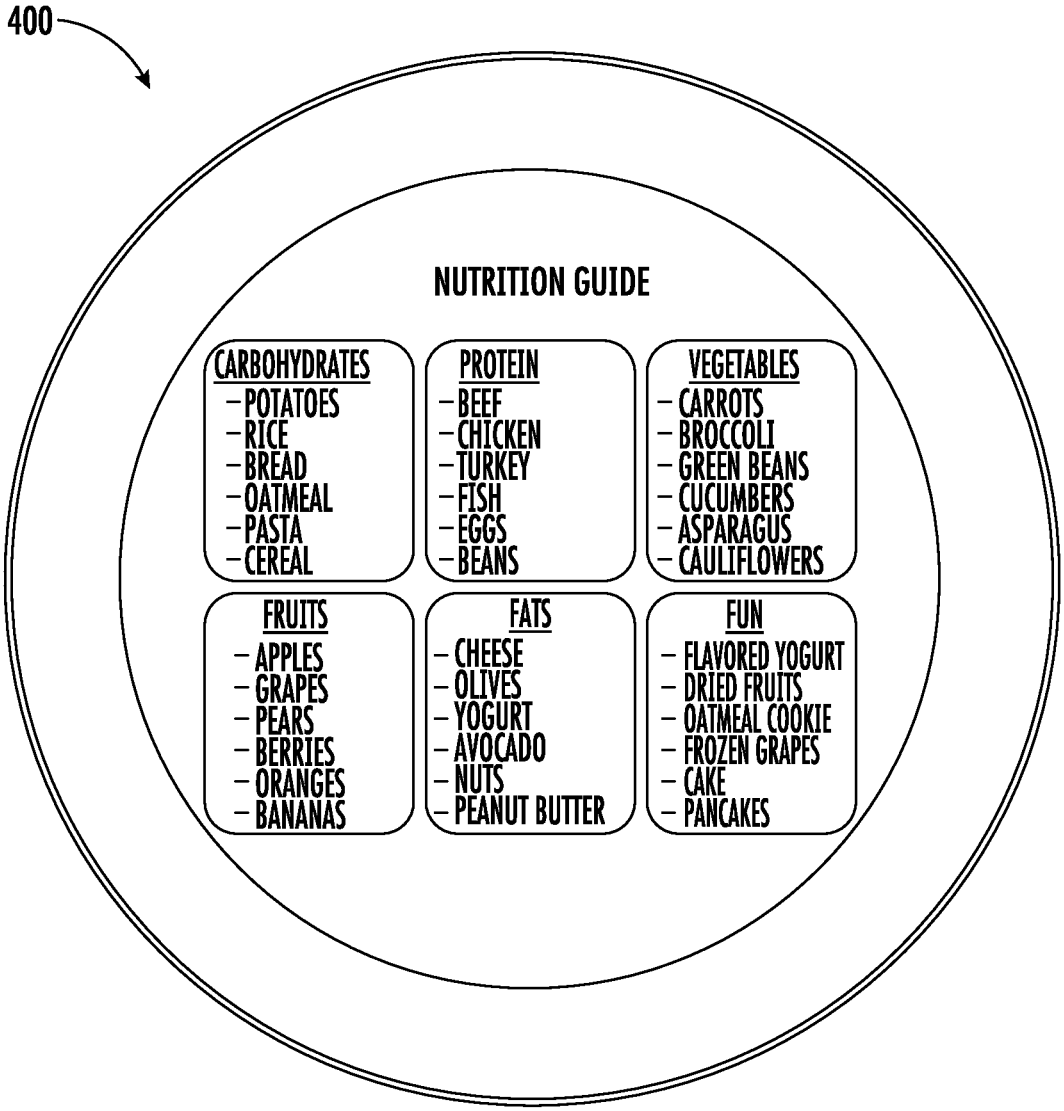
FIG. 26 is a bottom view of an embodiment of an exemplary information disk.

Referring to FIG. 26, an embodiment of the information disk 400 is illustrated. The information disk 400 includes six sections. In some embodiments, each of the sections of the information disk 400 correspond to a section of the plate shell 300. In other embodiments, at least one of the sections of the information disk 400 correspond to a section of the plate shell 300. Each section of the disk 400 includes at least one piece of information related to a meal. As shown, each section includes a food group and a plurality of food items that correspond to the food group.

In some embodiments, the information disk 400 includes a top side and a back side. The top side may include a configuration such as the information disk 400 illustrated in FIG. 24 and the bottom side may include a configuration such as the information disk illustrated in FIG. 26. In some embodiments, the top side and the bottom side have at least one section including a common piece of information related to a meal.

What is claimed is:

1. A plate assembly comprising:

a hoop comprising:

a hoop profile shape and a hoop cross-section shape and;

a plate shell comprising:

a first plate shell portion that receives food to be eaten and defines a food receiving surface; and a second plate shell portion defining a hoop receiving cavity on a bottom surface of the plate shell that is a downwardly facing opening having an exterior wall that extends downwardly to a distance level with the food receiving surface or below the food receiving surface, the hoop receiving cavity having a plate shell portion profile shape and a plate shell portion cross-section shape; and wherein hoop is matingly engaged with the downwardly facing opening of the hoop receiving cavity and the downwardly facing opening receives at least a portion of the hoop and the plate shell portion cross-sectional shape corresponds to at least a majority of the hoop cross-section shape of the hoop; and wherein the hoop is removably engaged and disengaged with the hoop receiving cavity of the plate shell by hand and without the use of tools and provides structural integrity to the plate shell when engaged with the hoop receiving cavity and the hoop extends to a bottom of the hoop receiving cavity or beyond when the hoop is spaced within the hoop receiving cavity.

2. The plate assembly of claim 1, wherein the first plate shell portion comprises at least one divider separating the first plate shell portion into a plurality of food receiving sections and wherein the hoop profile shape has an inner shape and an outer shape that may be the same or different form one another and the hoop cross-section shape has at least an outer shape and an inner shape where the inner shape and the outer shape of the hoop profile shape are the same or different and the outer shape and the inner shape of the hoop cross-section shape are the same or different from one another.

3. The plate assembly of claim 2, wherein the at least one divider comprises five dividers and the plurality of food receiving sections comprises six food receiving sections and wherein the inner shape and the outer shape of the hoop profile shape are both chosen from the group consisting of a circle and a rectangle and the inner shape and the outer shape of the hoop cross-section shape are both chosen from the group consisting of a circle and a rectangle and wherein the hoop comprises a material chosen from the group consisting of a silicone rubber, a foam material, and a base material coated with a silicone containing material.

4. The plate assembly of claim 3, wherein at least one of the six food receiving sections is shaped differently than at least one other of the six food receiving sections.

5. The plate assembly of claim 2, wherein the first plate shell portion includes an upward facing surface and a downward facing surface, and wherein an adhesive material is coupled to at least the downward facing surface of the first plate shell portion.

6. The plate assembly of claim 5, wherein the adhesive material is configured to at least partially affix the plate assembly to a table or tray used for eating.

7. The plate assembly of claim 6, wherein the adhesive material is pressure sensitive and requires a manually applied force applied by hand and without the use of tools to affix the plate assembly to the table or tray used for eating.

8. The plate assembly of claim 7, wherein the adhesive material is configured to at least partially fix the plate assembly to the table or tray used for eating when a force is applied to at least one of the plurality of food receiving sections of the plate shell.

9. The plate assembly of claim 5, wherein the adhesive material has a top and the top of the adhesive material is coupled to the bottom surface, and a backing material is coupled to the bottom of the adhesive material.

10. The plate assembly of claim 9, wherein the backing material comprises a top layer, a bend, and a bottom layer.

11. The plate assembly of claim 10, wherein the backing material the top layer is coupled to the adhesive material, and the backing material is configured to shear off the adhesive material.

12. The plate assembly of claim 2, wherein the plurality of food receiving sections each have a food receiving section shape and wherein the plate assembly further comprises an information disk including having a plurality of disk sections corresponding to the food receiving section shape and wherein each of the plurality of disk sections visually displays visual information of a specific food group for the corresponding section of the plate shell.

13. The plate assembly of claim 12, wherein the first plate shell portion is translucent or transparent and wherein the visual information may be seen by a user of the plate assembly through the first plate shell portion of the plate shell when the plate shell is positioned over the information disk.

14. The plate assembly of claim 13, wherein each disk section includes a label including at least one of a food group, a type of food, and a graphic of a food or food group and wherein the information disk further includes a top side facing a bottom surface of the first plate shell portion and the plurality of disk sections each include a label comprising a list of food groups including foods within each food group.

15. A plate assembly comprising:

a circumferential band of foam material having a top surface that defines an upwardly facing cross-sectional top surface profile and an exterior side facing surface; and a plate shell comprising:

a perimeter rim section having a bottom surface that is shaped to define an uncovered, downwardly facing u-shaped cavity and wherein the bottom surface of the perimeter rim section at least partially matingly engages the top surface of the circumferential band of foam material and wherein the bottom surface of the perimeter rim section has a cross-sectional shape that at least substantially corresponds to the upwardly facing cross-sectional top surface profile across at least a majority of the perimeter rim section when the perimeter rim section engages the circumferential band of foam material; and a food receiving section that is recessed below the perimeter rim section; and wherein the circumferential band of foam material and the plate shell engage and disengage one another by hand and without the use of tools and wherein the plate shell has a thickness of about 0.008 of an inch or less and the plate shell uses additional support from the circumferential band of foam material spaced within the uncovered, downwardly facing cross sectional U-shaped cavity to provide structural support to the plate shell during use.

16. The plate assembly of claim 15, wherein the plate shell is a single use plastic plate shell that is disposable or recyclable and a thickness of about 0.006 of an inch or less and wherein the circumferential band of foam material is frictionally held within the uncovered, downwardly facing cross sectional u-shaped cavity defined by a downwardly extending interior facing side wall of the perimeter rim section and a downwardly extending, exterior facing side wall of the perimeter rim section and may be placed within the cavity and removed from the cavity by hand and without the use of tools.

17. The plate assembly of claim 16, wherein the perimeter rim section further comprises a downwardly extending, exterior facing side wall and the circumferential band of foam material has an exterior facing side surface and wherein the downwardly extending, exterior facing side wall extends over at least a majority of the downwardly extending, exterior facing side surface when the circumferential band of foam material and the plate shell are engaged with one another to form the plate assembly.

18. The plate assembly of claim 16, wherein the downwardly extending side wall extends over all of the downwardly extending, exterior facing side wall when the circumferential band of foam material and the plate shell are engaged with one another to form the plate assembly.

19. The plate assembly of claim 16, wherein the downwardly extending interior facing side wall extends over all of the downwardly extending, interior facing side wall when the circumferential band of foam material and the plate shell are engaged with one another to form the plate assembly and wherein the food receiving section comprises at least one divider separating the food receiving section into a plurality of food receiving sections and wherein an adhesive material is coupled to at least a portion of a bottom surface of the food receiving section of the plate shell and wherein the adhesive material is pressure sensitive and requires a manually applied force to affix the plate assembly to a.

20. A kit comprising:

a circumferential band of material having a top surface that defines an upwardly facing cross-sectional top surface profile and an exterior side facing surface; and a plurality of plate shells, wherein each plate shell has a thickness of 0.008 of an inch or less and comprises:

a perimeter rim section having a bottom surface that is shaped to at least partially matingly engage the top surface of the circumferential band of material within an open, downwardly facing cavity having an exterior side wall and wherein the bottom surface of the perimeter rim section has a cross-sectional shape that at least substantially corresponds to the upwardly facing cross-sectional top surface profile across at least a majority of the perimeter rim section when the perimeter rim section engages the circumferential band of material; and a food receiving section that is recessed below a top of the perimeter rim section and even with or above a bottom edge of the exterior side wall of the open, downwardly facing cavity; and wherein the circumferential band of material and the plate shell engage and disengage one another by hand and without the use of tools and the circumferential band of material provides structural integrity to each of the plurality of plate shells when engaged with the perimeter rim section of each of the plurality of plate shells.

* * * * *